US009817330B2

(12) United States Patent
Tachibana et al.

(10) Patent No.: US 9,817,330 B2
(45) Date of Patent: Nov. 14, 2017

(54) IMAGE FORMING APPARATUS AND IMAGE FORMING METHOD TO FORM AN IMAGE BASED ON IMAGE DATA INCLUDING A PATTERN

(71) Applicants: Hiroto Tachibana, Kanagawa (JP); Hiroyuki Suhara, Kanagawa (JP); Masato Iio, Kanagawa (JP)

(72) Inventors: Hiroto Tachibana, Kanagawa (JP); Hiroyuki Suhara, Kanagawa (JP); Masato Iio, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 21 days.

(21) Appl. No.: 14/730,428

(22) Filed: Jun. 4, 2015

(65) Prior Publication Data

US 2015/0355568 A1 Dec. 10, 2015

(30) Foreign Application Priority Data

Jun. 5, 2014 (JP) ..... 2014-116324

(51) Int. Cl.
*G03G 15/04* (2006.01)
*G03G 15/043* (2006.01)
(Continued)

(52) U.S. Cl.
CPC ..... *G03G 15/043* (2013.01); *B41J 2/435* (2013.01); *G03G 13/045* (2013.01); *G03G 15/045* (2013.01); *G03G 15/04027* (2013.01)

(58) Field of Classification Search
CPC ..... G03G 15/163; G03G 15/1635; G03G 15/1645; G03G 13/04; G03G 13/045
(Continued)

(56) References Cited

U.S. PATENT DOCUMENTS 5,834,766 A 11/1998 Suhara
6,081,386 A 6/2000 Hayashi et al.
(Continued)

FOREIGN PATENT DOCUMENTS

JP H08-130646 5/1996
JP 2003-230009 8/2003
(Continued)

OTHER PUBLICATIONS

U.S. Appl. No. 14/705,423, filed May 6, 2015, Suhara, et al.
U.S. Appl. No. 14/705,423, filed May 6, 2015.
U.S. Appl. No. 14/564,466, filed Dec. 9, 2014.

*Primary Examiner* — Kristal Feggins
*Assistant Examiner* — Kendrick Liu
(74) *Attorney, Agent, or Firm* — Oblon, McClelland, Maier & Neustadt, L.L.P.

(57) ABSTRACT

An image forming apparatus forms an image by exposing an image bearer on the basis of image data including at least one predetermined pattern. The image forming apparatus includes a processing device that sets an exposure amount of a plurality of exposure pixels. The predetermined pattern is constituted by the plurality of exposure pixels, and a peripheral region of the predetermined pattern in the image data is constituted by a plurality of non-exposure pixels. The processing device sets an exposure amount of an exposure pixel in a specific region that is adjacent to a boundary between the predetermined pattern and the peripheral region and is constituted by at least one exposure pixel in the predetermined pattern, and an exposure amount of an exposure pixel in a region other than the specific region in the predetermined pattern to values different from each other.

18 Claims, 30 Drawing Sheets

(51) Int. Cl.
*G03G 15/045* (2006.01)
*G03G 13/045* (2006.01)
*B41J 2/435* (2006.01)

(58) Field of Classification Search
USPC ..... 347/116, 118, 131, 135, 143, 144, 240, 347/251–254
See application file for complete search history.

(56) References Cited

U.S. PATENT DOCUMENTS 6,292,205 B1 9/2001 Nakayasu et al.
6,400,391 B1 6/2002 Suhara et al.
6,555,810 B1 4/2003 Suhara
7,598,971 B2 * 10/2009 Tezuka ..... G03G 15/0142 347/116
8,982,422 B2 * 3/2015 Iwata ..... H04N 1/40037 347/135
2001/0048542 A1 12/2001 Suhara
2002/0080428 A1 6/2002 Suzuki et al.
2002/0163571 A1 11/2002 Suhara et al.
2003/0063358 A1 4/2003 Suhara
2004/0179255 A1 9/2004 Suhara
2004/0196520 A1 10/2004 Suhara et al.
2005/0128615 A1 6/2005 Suhara et al.
2005/0179971 A1 8/2005 Amada et al.
2006/0245794 A1 11/2006 Honda et al.
2006/0262417 A1 11/2006 Suhara
2008/0056746 A1 3/2008 Suhara
2008/0095553 A1 4/2008 Tanaka et al.
2008/0170282 A1 7/2008 Amada et al.
2008/0292341 A1 * 11/2008 Yamamoto ..... B41J 2/45 399/51
2009/0051982 A1 2/2009 Suhara
2009/0154946 A1 6/2009 Nakase
2009/0220256 A1 9/2009 Suhara et al.
2010/0054829 A1 3/2010 Iio et al.
2010/0196052 A1 8/2010 Suhara
2011/0142464 A1 6/2011 Nakase
2011/0223527 A1 9/2011 Iio et al.
2012/0082829 A1 4/2012 Iio et al.
2012/0243890 A1 9/2012 Iio et al.
2012/0315057 A1 12/2012 Nakase
2014/0253658 A1 9/2014 Suhara et al.
2014/0255069 A1 9/2014 Iio et al.
2015/0042740 A1 2/2015 Suhara et al.

FOREIGN PATENT DOCUMENTS

JP 3470626 9/2003
JP 3880234 11/2006
JP 2009-145506 7/2009
JP 5142636 11/2012
JP 2013-257510 12/2013

* cited by examiner

COROTRON CHARGING

COROTRON CHARGING

ONE-dot LATTICE

TWO-dot ISOLATION 2 by 2

TWO-dot LINE

SPECIFIC EXAMPLES OF ISOLATED PATTERN (FIVE EXAMPLES)

EXPOSURE METHOD OF RELATED ART TIME 100% OPTICAL OUTPUT 100%

TC EXPOSURE TIME 50% OPTICAL OUTPUT 200%

TC EXPOSURE TIME 25% OPTICAL OUTPUT 400%

TC EXPOSURE TIME 12.5% OPTICAL OUTPUT 800%

IMAGE FORMING APPARATUS AND IMAGE FORMING METHOD TO FORM AN IMAGE BASED ON IMAGE DATA INCLUDING A PATTERN

CROSS-REFERENCE TO RELATED APPLICATIONS

The present application claims priority to and incorporates by reference the entire contents of Japanese Patent Application No. 2014-116324 filed in Japan on Jun. 5, 2014.

BACKGROUND OF THE INVENTION

1. Field of the Invention

The present invention relates to an image forming apparatus and an image forming method.

2. Description of the Related Art

In the related art, an image forming apparatus, in which an image is formed by exposing an image bearer on the basis of image data, is known (for example, refer to Japanese Laid-open Patent Publication No. 2013-257510).

However, in the image forming apparatus disclosed in Japanese Laid-open Patent Publication No. 2013-257510, there is room for improvement in reproducibility of an image.

Therefore, it is desirable to provide an image forming apparatus and an image forming method capable of improving the reproducibility of an image.

SUMMARY OF THE INVENTION

It is an object of the present invention to at least partially solve the problems in the conventional technology.

According to an aspect of the present invention, there is provided an image forming apparatus that forms an image by exposing an image bearer on the basis of image data including at least one predetermined pattern, including: a processing device that sets an exposure amount of a plurality of exposure pixels, wherein the predetermined pattern is constituted by the plurality of exposure pixels, and a peripheral region of the predetermined pattern in the image data is constituted by a plurality of non-exposure pixels, and the processing device sets an exposure amount of an exposure pixel in a specific region that is adjacent to a boundary between the predetermined pattern and the peripheral region and is constituted by at least one exposure pixel in the predetermined pattern, and an exposure amount of an exposure pixel in a region other than the specific region in the predetermined pattern to values different from each other.

According to another aspect of the present invention, there is provided an image forming apparatus that forms an image by exposing an image bearer on the basis of image data including at least one predetermined pattern, including: a processing device that sets an exposure amount of a plurality of exposure pixels, wherein a peripheral region of the predetermined pattern in the image data is constituted by the plurality of exposure pixels, and the predetermined pattern is constituted by a plurality of non-exposure pixels, and the processing device sets an exposure amount of an exposure pixel in a specific region that is adjacent to a boundary between the predetermined pattern and the peripheral region and is constituted by at least one exposure pixel in the peripheral region, and an exposure amount of an exposure pixel in a region other than the specific region in the peripheral region to values different from each other.

According to still another aspect of the present invention, there is provided an image forming method that forms an image by exposing an image bearer on the basis of image data including at least one predetermined pattern, including: detecting a specific region, which is adjacent to a boundary of the predetermined pattern and a peripheral region of the predetermined pattern in the image data, and includes at least one exposure pixel in the predetermined pattern, the predetermined pattern being constituted by a plurality of exposure pixels, and the peripheral region being constituted by a plurality of non-exposure pixel; and setting an exposure amount of an exposure pixel in the specific region and an exposure amount of an exposure pixel in a region other than the specific region in the predetermined pattern to values different from each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
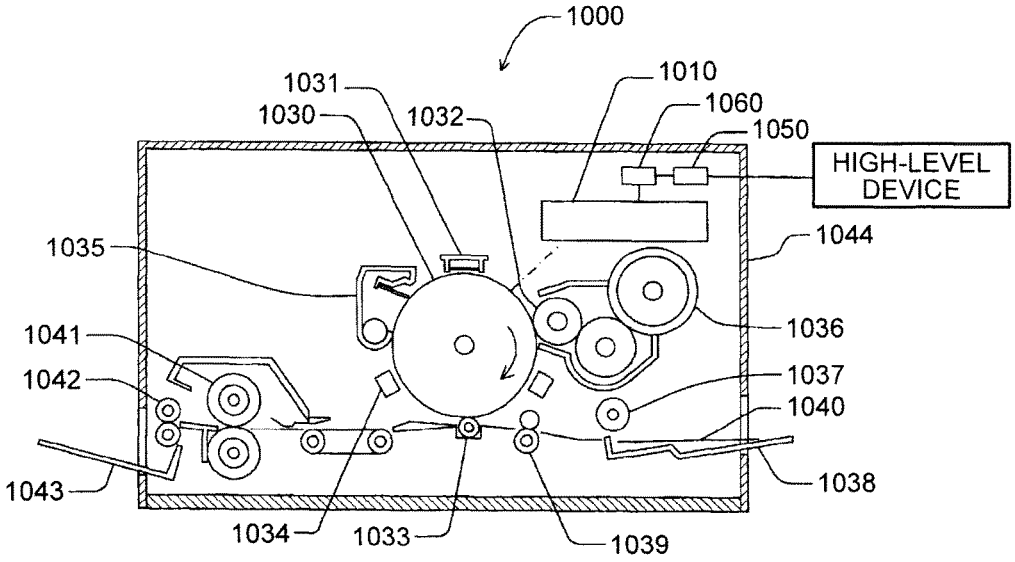
FIG. 1 is a view illustrating a schematic configuration of a laser printer according to one embodiment.

Hereinafter, one embodiment of the invention will be described on the basis of FIG. 1 to FIG. 31. FIG. 1 illustrates a schematic configuration of a laser printer 1000 according to the one embodiment.

The laser printer 1000 includes an optical scanning device 1010 as an exposure device, a photoconductor drum 1030 as an image bearer, an electrification charger 1031, a developing roller 1032, a transfer charger 1033, a destaticizing unit 1034, a cleaning unit 1035, a toner cartridge 1036, a paper feeding roller 1037, a paper feeding tray 1038, a registration roller pair 1039, a fixing roller 1041, a paper ejection roller 1042, a paper ejection tray 1043, a scanner 10 (refer to FIG. 4) as an original document reading device, a communication control device 1050, a printer control device 1060 (processing device), and the like. In addition, these components are accommodated at a predetermined position at the inside of a printer casing 1044.

The communication control device 1050 controls bi-directional communication with a high-level device (for example, a PC) through a network and the like.

The photoconductor drum 1030 is a cylindrical member, and a photosensitive layer is formed on a surface thereof. That is, the surface of the photoconductor drum 1030 is a surface to be scanned. In addition, the photoconductor drum 1030 is configured to rotate in the arrow direction of FIG. 1.

The electrification charger 1031, the developing roller 1032, the transfer charger 1033, the destaticizing unit 1034, and the cleaning unit 1035 are disposed in the vicinity of the surface of the photoconductor drum 1030, respectively. In addition, these components are disposed in the order of the electrification charger 1031→the developing roller 1032→the transfer charger 1033→the destaticizing unit 1034→the cleaning unit 1035 along a rotation direction of the photoconductor drum 1030.

The electrification charger 1031 uniformly charges the surface of the photoconductor drum 1030.

Figure 2A:
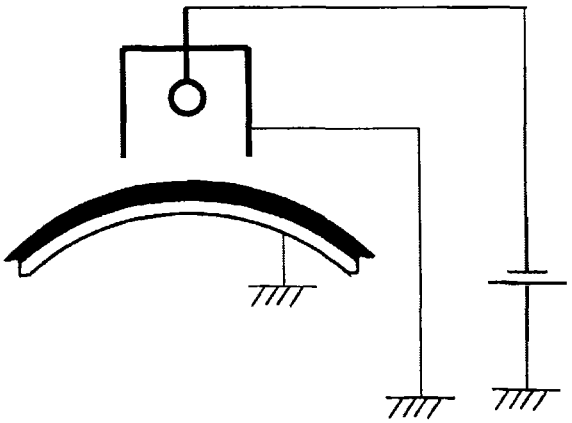
FIGS. 2A and 2B are views illustrating corotron charging and scorotron charging.
Figure 2B:
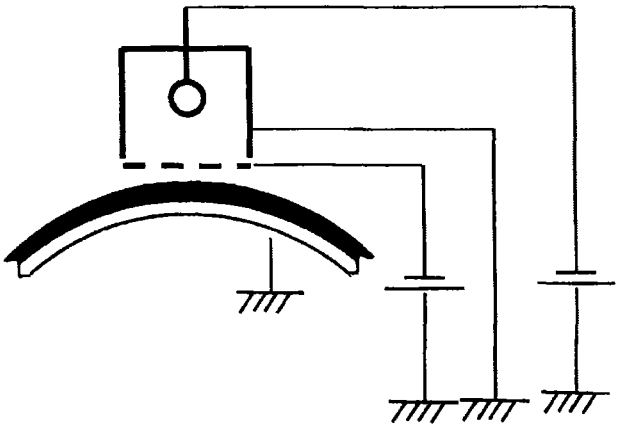

The electrification charger 1031 can create a desired potential through corotron charging as illustrated in FIG. 2A, scorotron charging as illustrated in FIG. 2B, or charging with a roller.

The optical scanning device 1010 scans the surface of the photoconductor drum 1030, which is charged with the electrification charger 1031, with laser light that is modulated on the basis of image data (image information) transmitted from a high-level device such as PC. As a result, an electrostatic latent image, which corresponds to the image data, is formed on the surface of the photoconductor drum 1030. The electrostatic latent image that is formed is moved in a direction of the developing roller 1032 in association with rotation of the photoconductor drum 1030. In addition, a configuration of the optical scanning device 1010 will be described later.

A toner is stored in the toner cartridge 1036, and the toner is supplied to the developing roller 1032.

The developing roller 1032 attaches a toner, which is supplied from the toner cartridge 1036, to the electrostatic latent image that is formed on the surface of the photoconductor drum 1030 to develop the electrostatic latent image. The electrostatic latent image (hereinafter, referred to as a "toner image" for convenience) to which the toner is attached is moved in a direction of the transfer charger 1033 in association with rotation of the photoconductor drum 1030.

Recording paper 1040 is stored in the paper feeding tray 1038. The paper feeding roller 1037 is disposed in the vicinity of the paper feeding tray 1038, and the paper feeding roller 1037 takes out the recording paper 1040 sheet by sheet from the paper feeding tray 1038, and transports the recording paper to the registration roller pair 1039. The registration roller pair 1039 temporarily holds the recording paper 1040 that is taken out by the paper feeding roller 1037, and transports the recording paper 1040 toward a gap between the photoconductor drum 1030 and the transfer charger 1033 in accordance with rotation of the photoconductor drum 1030.

A voltage with polarity reversed from that of the toner is applied to the transfer charger 1033 so as to electrically attract the toner on the surface of the photoconductor drum 1030 to the recording paper 1040. A toner image on the surface of the photoconductor drum 1030 is transferred to the recording paper 1040 by the voltage. The recording paper 1040 to which the toner image is transferred is transported to the fixing roller 1041.

In the fixing roller 1041, heat and pressure are applied to the recording paper 1040, and according to this, the toner is fixed onto the recording paper 1040. The recording paper 1040 onto which the toner is fixed is transported to the paper ejection tray 1043 through the paper ejection roller 1042, and is sequentially stacked on the paper ejection tray 1043.

The destaticizing unit 1034 destaticizes the surface of the photoconductor drum 1030.

The cleaning unit 1035 removes the toner (residual toner) that is left on the surface of the photoconductor drum 1030. The surface of the photoconductor drum 1030 from which the residual toner is removed is returned again to a position that faces the electrification charger 1031.

Figure 3A:
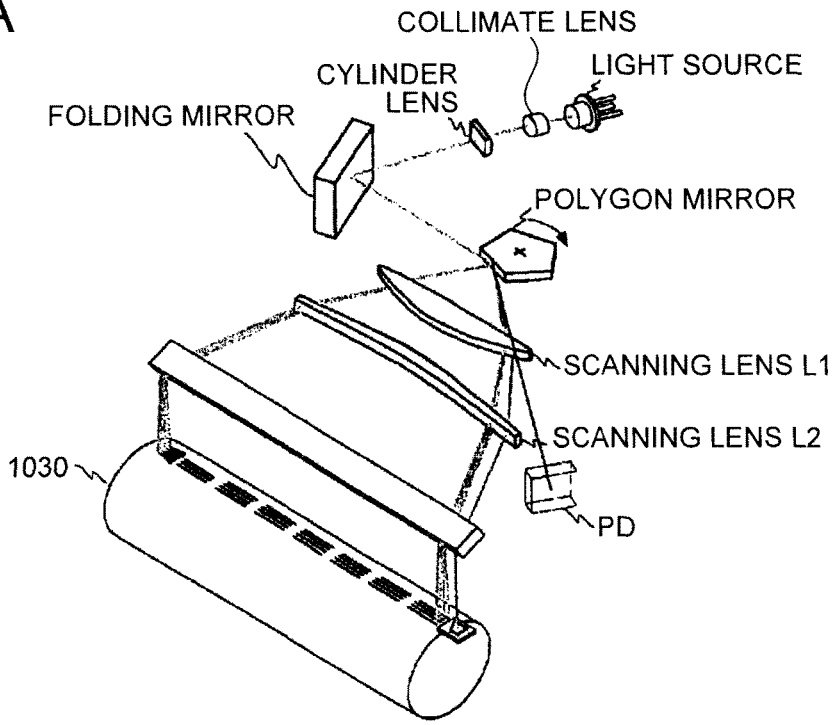
FIGS. 3A to 3C are views (first to third views) illustrating an optical scanning device in FIG. 1.

Next, a configuration of the optical scanning device 1010 will be described. As illustrated in FIG. 3A, as an example, the optical scanning device 1010 includes a light source including a plurality of light-emitting units, a collimator lens, a cylinder lens, a folding mirror, a polygon mirror, a scanning lens L1, a scanning lens L2, a PD (photo detector) as a light-receiving element, a scanning control device 15 (refer to FIG. 4), and the like. These components are assembled at a predetermined position in a housing (not illustrated).

A light beam that is emitted from the light source is made into approximately parallel light by the collimator lens, and is incident to the cylinder lens as a linear imaging forming optical system. The cylinder lens has power only in a sub-scanning direction, allows a plurality of incident light beams to converge only in the sub-scanning direction, and forms an image in the vicinity of a reflection surface of the polygon mirror as a linear image that is elongated in a main-scanning direction.

Here, a motor unit and a drive IC (not illustrated) which drive the polygon mirror are provided. When an appropriate clock is applied to the drive IC, the motor unit is rotated at a predetermined velocity.

When the polygon mirror is rotated by the motor unit at a constant velocity in the arrow direction in FIG. 3A, the plurality of light beams which are reflected from a deflective reflection surface of the polygon mirror become deflected beams, and are deflected at a constant angular velocity.

The deflected beams are transmitted through the scanning lenses L1 and L2 as a scanning imaging forming optical system while being deflected, and are reflected from the folding mirror that is a long planar mirror. According to this, an optical path of the beams is bent, and the beams are focused to the surface (surface to be scanned) of the photoconductor drum 1030 as a light spot due to operation of the scanning lenses L1 and L2.

In this manner, the optical scanning device 1010 simultaneously scans a plurality of lines on the surface to be scanned through scanning by one deflective reflection surface of the polygon mirror.

As a result, an electrostatic latent image corresponding to the image data is formed on the photoconductor drum 1030.

In addition, laser light that is deflected by the polygon mirror is incident to the PD after completion of scanning with respect to one line, or before initiation of scanning with respect to one line. When receiving laser light, the PD converts an amount of light received into an electrical signal, and outputs the electrical signal to the following scanning control device 15 that controls a light source.

Printing data for one line which corresponds to each light-emitting portion of the light source is stored in a buffer memory inside the scanning control device 15. The printing data is read out for one deflective reflection surface of the polygon mirror, a light beam flickers on a scanning line on the photoconductor drum 1030 in correspondence with the printing data, and an electrostatic latent image is formed in accordance with the scanning line.

Figure 3B:
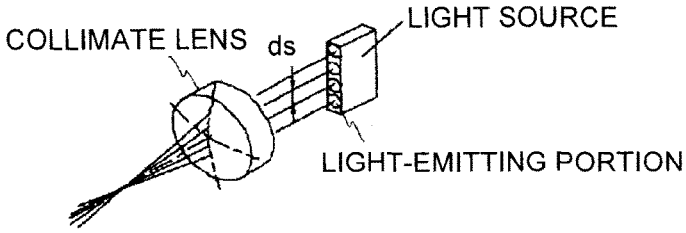

As an example of the light source, FIG. 3B illustrates a semiconductor laser array in which four light-emitting portions (semiconductor lasers) are one-dimensionally arranged in a direction perpendicular to an optical axis of the collimator lens.

Figure 3C:
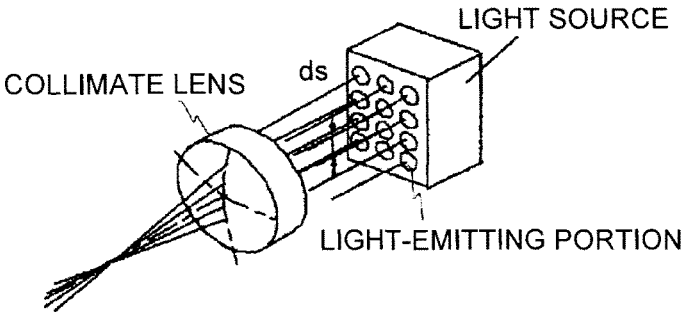

An example of the light source, FIG. 3C illustrates a surface light-emitting laser array in which 12 light-emitting portions (surface light-emitting lasers: VCSEL) are two-dimensionally arranged along a plane perpendicular to the optical axis of the collimator lens. Here, the 12 light-emitting portions are lined up in a matrix shape including three rows in a horizontal direction (main-scanning direction) and four columns in a vertical direction (sub-scanning direction). In this case, four scanning lines in the vertical direction can be simultaneously scanned by scanning a location on one scanning line with the three light-emitting portions which are lined up in the horizontal direction.

Here, a mechanism in which the electrostatic latent image is formed on the photoconductor will be described in brief. The photoconductor (OPC) is constituted by a charge generating layer (CGL) and a charge transportation layer (CTL) on a conductive support. When the photoconductor is exposed in a state in which a surface thereof is charged, light is absorbed thereto due to a charge generating material (CGM) of the CGL, and thus charge carriers of both positive and negative polarities are generated. Due to an electric field, one of the carriers is injected into the CTL and the other is injected into the conductive support. The carrier, which is injected into the CTL, is moved in the CTL up to a surface of the CTL due to an electric field, and disappears after being coupled with a charge on the surface of the photoconductor. UL has a function of blocking charge injection from the conductive support. According to this, a charge distribution, that is, an electrostatic latent image is formed on the surface of the photoconductor.

Here, the printer control device 1060 will be described.

Figure 4:
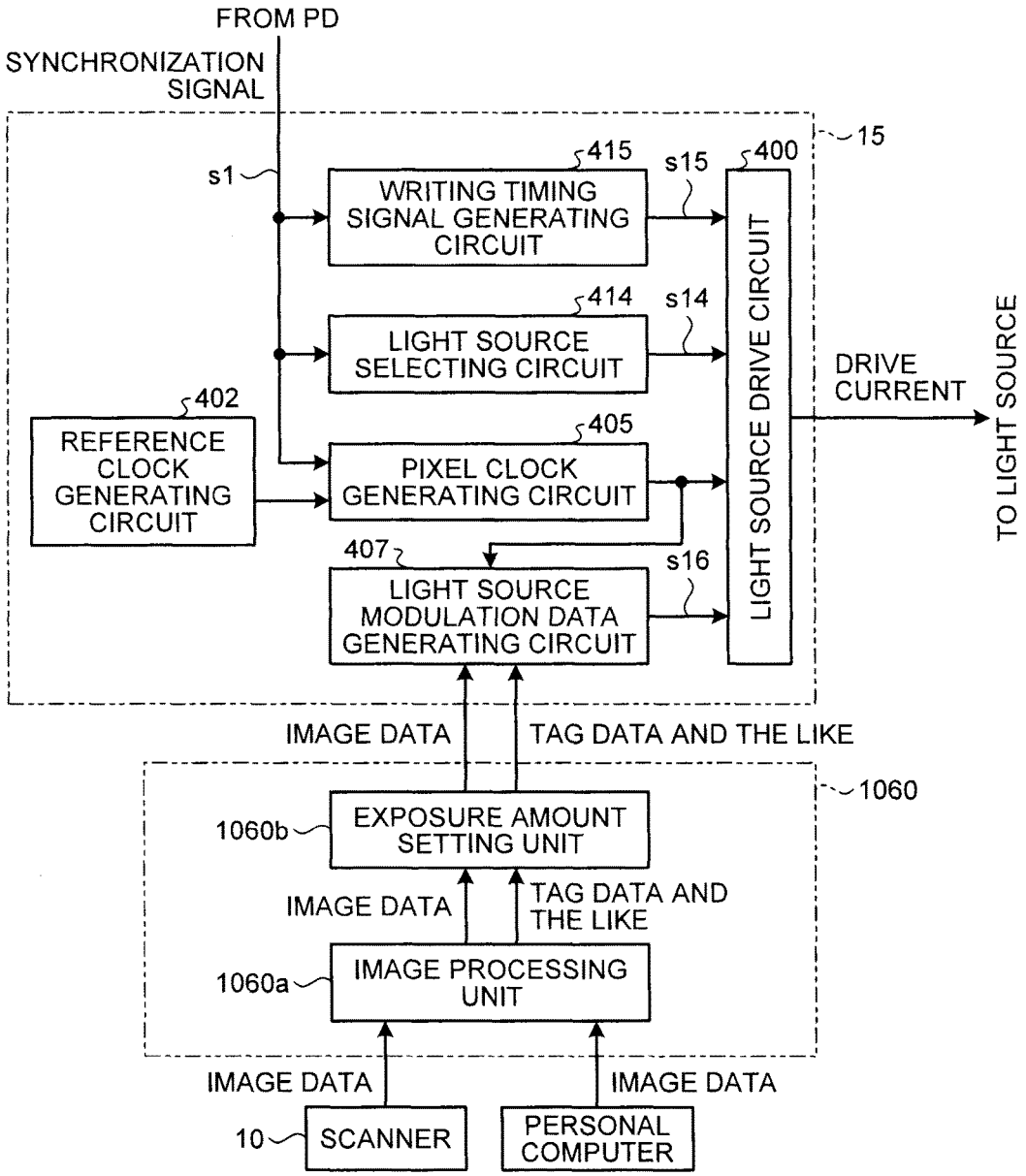
FIG. 4 is a block diagram illustrating a printer control device and a scanning control device.

As illustrated in FIG. 4, the printer control device 1060 includes a control unit (not illustrated) that integrally controls respective constituent units of the laser printer 1000, an image processing unit 1060*a*, an exposure amount setting unit 1060*b*, and the like.

Figure 5A:
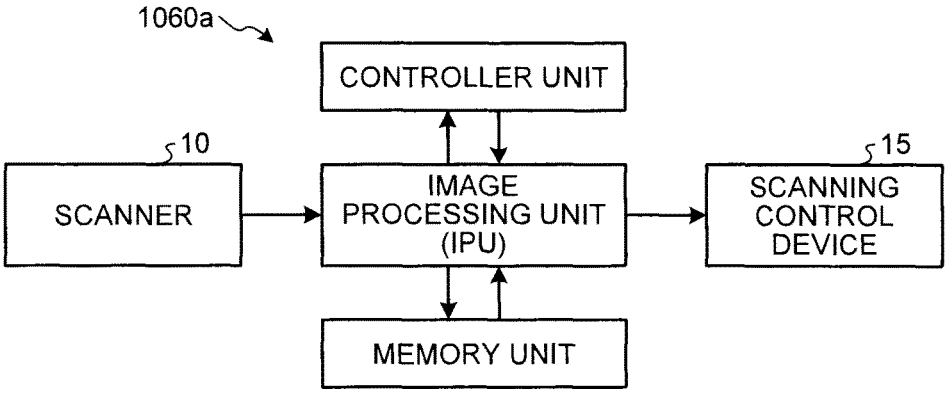
FIGS. 5A and 5B are views (first and second views) illustrating an image processing unit.

As illustrated in FIG. 5A, the image processing unit 1060*a* includes an image processing unit (IPU), a controller unit, a memory unit, and the like.

Figure 5B:
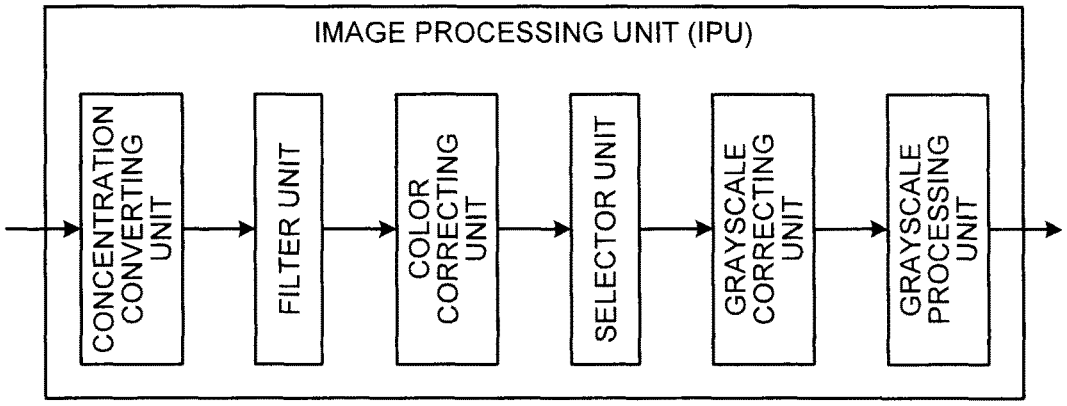

As illustrated in FIG. 5B, the image processing unit includes a concentration converting unit, a filter unit, a color correcting unit, a selector unit, a grayscale correcting unit, a grayscale processing unit, a unit control unit (not illustrated) that integrally controls the respective units.

The concentration converting unit converts RGB image data transmitted from the scanner 10 or a PC into concentration data by using a look-up table, and outputs the concentration data to the filter unit.

The filter unit performs an image correcting process such as a smoothing process and an edge emphasizing process with respect to the concentration data that is input from the concentration converting unit, and outputs the concentration data to the color correcting unit.

The color correcting unit performs a color correcting (masking) process with respect to image-corrected concentration data that is input from the filter unit, and outputs the data to a selector unit.

The selector unit selects any one of C, M, Y, and K with respect to color-corrected concentration data that is input from the color correcting unit under the control of the unit control unit, and outputs the selected one to the grayscale correcting unit.

The grayscale correcting unit sets a γ curve, from which linear characteristic obtained, with respect to the concentration data of C, M, Y, and K which is input from the selector unit.

The grayscale processing unit performs grayscale processing such as teaser processing with respect to concentration data to which the γ-curve is set and which is input from the grayscale correcting unit.

In addition, the image processing unit outputs image data before image processing or image data (concentration data) after the image processing to the controller unit as necessary.

The controller unit performs processing such as rotation, repeat, aggregation, compression, and expansion with respect to the image data transmitted from the image processing unit, and outputs the image data to the image processing unit.

Various pieces of data such as the look-up table are stored in advance in the memory unit.

The image data, which is subjected to the above-described series of processing in the image processing unit 1060*a*, tag data that identifies object information, and the like are output to the exposure amount setting unit 1060*b*.

The exposure amount setting unit 1060*b* sets an exposure amount of each exposure pixel which is transmitted from the image processing unit 1060*a* and is the image data after the image processing, and outputs the image data after setting of the exposure amount, the tag data, and the like to the scanning control device 15. The exposure amount setting unit 1060*b* will be described later in detail. In addition, in the image data that is transmitted from the image processing unit 1060*a* to the exposure amount setting unit 1060*b*, white portion (non-exposure portion) and a black portion (exposure portion) are designated for each pixel.

The optical scanning device 2 including the scanning control device 15 scans the surface of the photoconductor drum 1030 on the basis of the image data after setting of the exposure amount, the tag data, and the like which are transmitted from the exposure amount setting unit 1060*b* to form an electrostatic latent image on the surface of the photoconductor drum 1030.

As will be described below in detail, the scanning control device 15 performs input of the image data, the tag data, and the like which are transmitted from the exposure amount setting unit 1060*b* as necessary to generate drive information of the light source, and drives respective light-emitting portions of the light source by using the drive information.

As illustrated in FIG. 4, the scanning control device 15 includes a reference clock generating circuit 402, a pixel clock generating circuit 405, a light source modulation data generating circuit 407, a light source selecting circuit 414, a writing timing signal generating circuit 415, and a light source driving circuit 400. In addition, arrows indicate a flow of a representative signal or information, and are not intended to indicate all connection relationships of respective blocks.

The reference clock generating circuit 402 generates a high-frequency clock signal that becomes a reference of the entirety of the scanning control device 15.

The pixel clock generating circuit 405 is mainly constituted by a PLL circuit, and generates a pixel clock signal on the basis of a synchronization signal s1 and the high-frequency clock signal that is transmitted from the reference clock generating circuit 402. The pixel clock signal has the same frequency as that of the high-frequency clock signal, and a phase thereof is equal to a phase of the synchronization signal s1. Accordingly, when the image data is synchronized with the pixel clock signal, a recording position for each scanning can be arranged. The pixel clock signal that is generated here is supplied to the light source driving circuit 400 as one of the drive information, and is supplied to the light source modulation data generating circuit 407 and is used a clock signal of recording data s16 as one of the drive information.

The light source modulation data generating circuit 407 converts the image data to a PM+PWM signal on the basis of the image data or the tag data which is transmitted from the exposure amount setting unit 1060*b* in order for an optimal latent image to be formed.

The light source selecting circuit 414 is a circuit that is used in a case where the light source includes a plurality of light-emitting portions. When an image surface of scanning light reaches a scanning distal end, the light source selecting circuit 414 selects a light-emitting portion that is used to sense initiation of the subsequent scanning from the plurality of light-emitting portions (for example, 32 light-emitting portions) and outputs a signal designating the selected light-emitting portion. An output signal s14 of the light source selecting circuit 414 is supplied to the light source driving circuit 400 as one of the drive information. In addition, in the case of using a single light-emitting portion as the light source, the light source selecting circuit 414 may not be provided.

The writing timing signal generating circuit 415 obtains a writing initiation timing on the basis of the synchronization signal s1, and outputs an output signal s15, which is the timing signal, to the light source driving circuit 400 as one of the drive information.

The light source driving circuit 400 generates a drive current (for example, a pulse current) of each of the light-emitting portions of the light source on the basis of the drive information, and supplies the drive current to the corresponding light-emitting portion.

Next, description will be given of a device (an electrostatic latent image measuring device) that measures the electrostatic latent image formed on the photoconductor drum with reference to FIG. 6.

Figure 6:
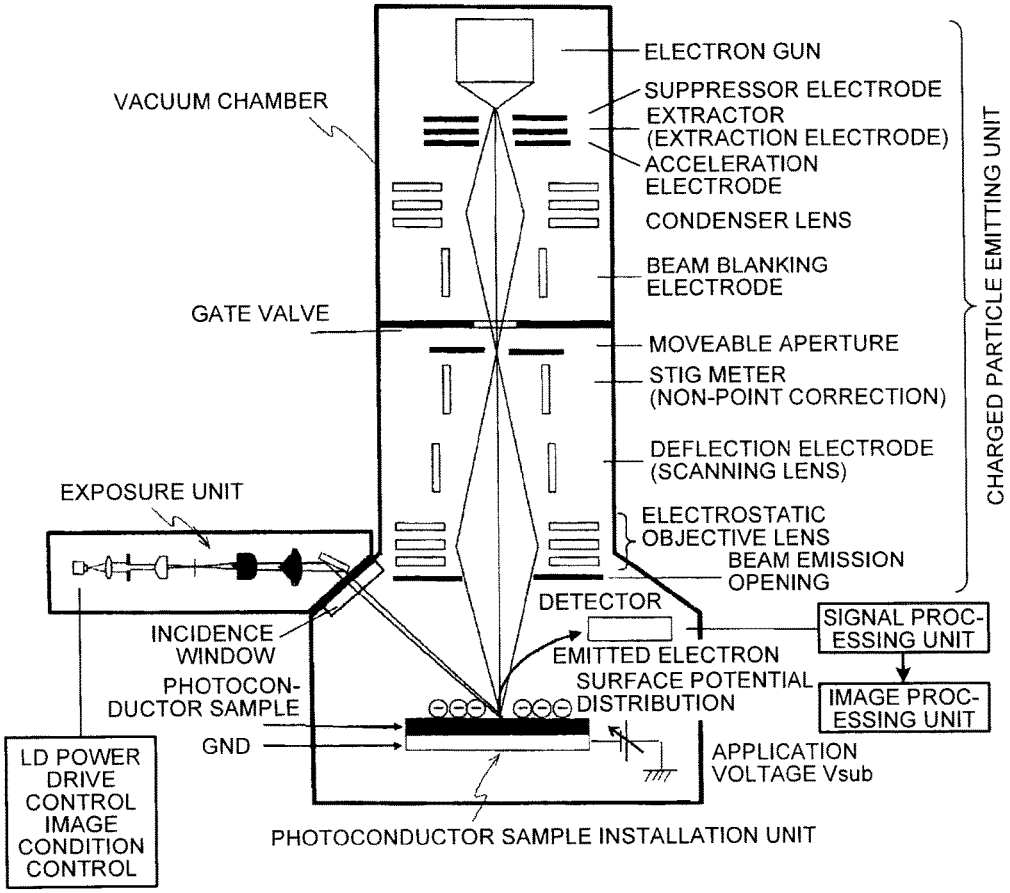
FIG. 6 is a view illustrating an electrostatic latent image measuring device.

As illustrated in FIG. 6, the electrostatic latent image measuring device includes a charged particle emitting unit that emits charged particle beams, an exposure unit, a photoconductor sample installation unit, a plurality of voltage power supplies which apply an appropriate voltage to the photoconductor sample, a detection unit that detects primary inverted charged particles, secondary electrons, and the like.

The "charged particles" stated here represent particles such as electron beams or ion beams which are affected by an electric field or a magnetic field. Hereinafter, an example of irradiation using the electron beams will be described.

The charged particle emitting unit includes an electron gun that generates electron beams, a suppressor electrode and an extraction electrode which control the electron beams, an acceleration electrode that controls the energy of the electron beams, a condenser lens that focuses the electron beams generated from the electron gun, a movable aperture that controls an irradiation current relating to the electron beams, a beam blanking electrode that controls ON/OFF of the electron beams, a scanning lens that allows scanning with the electron beams which passes through the beam blanking electrode, and an objective lens that condenses again the electron beams which pass through the scanning lens. A drive power supply (not illustrated) is connected to each of the lenses.

In addition, in the case of the ion beams, a liquid metal ion gun and the like are used instead of the electron gun.

The exposure unit may have the same configuration as that of an actual machine (the optical scanning device 1010), and may have a configuration for evaluation only in which charging and exposure conditions can be changed in various manners.

Specifically, the exposure unit includes a light source such as an LD (laser diode) with an oscillation wavelength having sensitivity for the photoconductor, a collimator lens, an aperture, a condenser lens, and the like, and can irradiate the surface of the photoconductor sample with a light spot having a desired beam diameter and a desired beam profile. At this time, appropriate exposure time and exposure intensity are controlled by a light source control circuit.

In addition, the exposure unit may be provided with a scanning mechanism using a galvano mirror or a polygon mirror as an optical system so as to form a linear pattern. In addition, a multi-beam light source such as the LD array and the VCSEL array, which are illustrated in FIG. 3B and FIG. 3C, is also possible.

In addition, a type, in which a scanning mechanism is also provided in a sub-scanning direction in addition to the main-scanning direction and which is capable of forming a two-dimensional exposure pattern, is also possible.

It is preferable that the exposure unit be provided at the outside of a vacuum chamber, in which the charged particle emitting unit is accommodated, in order for vibration of a deflector such as a polygon mirror and an electromagnetic field not to have an effect on an orbit of electron beams. When the exposure unit is spaced away from the charged particle emitting unit, it is possible to suppress an effect of disturbance. It is preferable that light from the exposure unit be incident from an optically transparent incidence window that is provided in the vacuum chamber.

Figure 7:
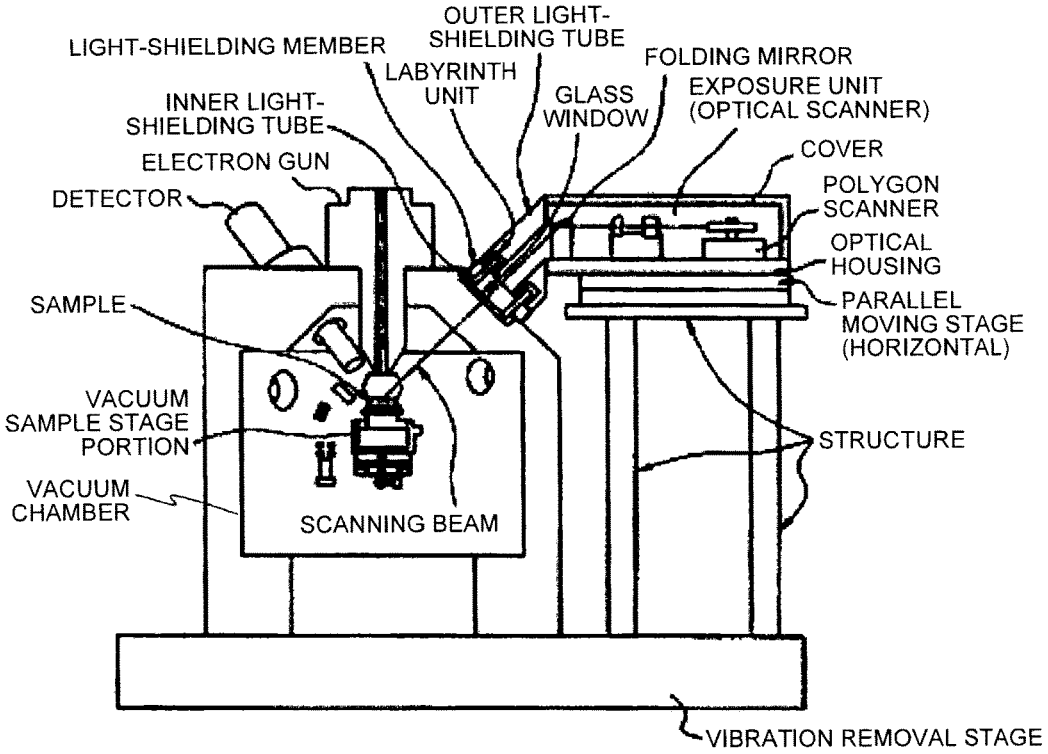
FIG. 7 is a cross-sectional view illustrating a vacuum chamber.

FIG. 7 illustrates a cross-sectional view of the electrostatic latent image measuring device including the exposure unit having the above-described scanning mechanism. As illustrated in FIG. 7, a glass window, through which light from the light source can be incident to the inside of the vacuum chamber from an outer side, is provided at a position of 45° with respect to a vertical axis of the vacuum chamber, and the exposure unit (optical unit) is disposed at the outside of the vacuum chamber. Here, the exposure unit includes a light source, an optical deflector (polygon scanner in FIG. 7), a scanning lens, a synchronization sensing unit, and the like.

An optical housing that holds the exposure unit may have a configuration in which the entirety of the exposure unit is covered with a cover to shield external light (harmful light) that is incident to the inside of the vacuum chamber.

The scanning lens has fθ characteristics, and has a configuration in which when the optical deflector is rotated at a constant velocity, light beams are moved at an approximately constant velocity with respect to the image surface. In addition, the scanning lens has a configuration capable of performing scanning while maintaining an approximately constant beam spot diameter.

The exposure unit is disposed to be spaced from the vacuum chamber. Accordingly, vibration, which occurs during driving of the optical deflector such as the polygon scanner, has a less effect due to direct propagation to the vacuum chamber. Furthermore, although not illustrated in FIG. 7, when a damper is inserted between a structure and a vibration removal stage, a further higher vibration removal effect can be obtained.

As described above, when the exposure unit includes the scanning mechanism, it is possible to form an arbitrary latent image pattern including a line pattern with respect to a generating line direction of the photoconductor sample.

In addition, the exposure unit may be provided with the synchronization sensing unit that senses scanning beams from the optical deflector so as to form a latent image pattern at a predetermined position.

In addition, a shape of the sample may be a planar surface or a curbed surface.

Figure 8A:
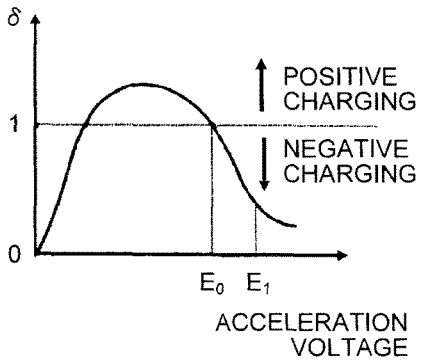
FIG. 8A is a graph illustrating a relationship between an acceleration voltage and charging.
Figure 8B:
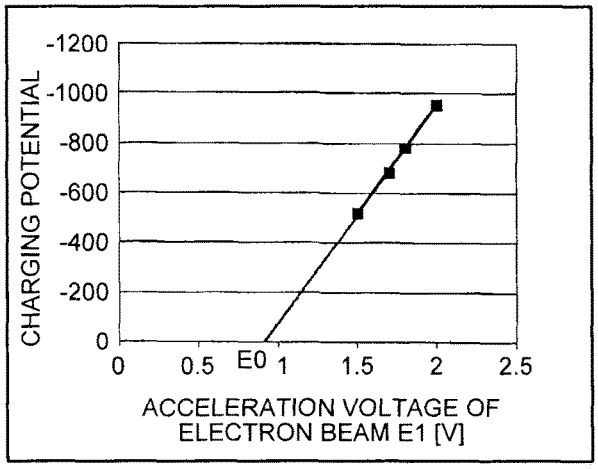
FIG. 8B is a graph illustrating a relationship between an acceleration voltage and a charging potential.

Hereinafter, description will be given of a method of measuring the electrostatic latent image by using the electrostatic latent image measuring device. First, the photoconductor sample is irradiated with electron beams. When an acceleration voltage |Vacc| is set to an acceleration voltage that is higher than an acceleration voltage at which a secondary electron emission ratio becomes 1, an amount of incident electrons is greater than an amount of emitted electrons, and thus electrons are accumulated in a sample and charge-up is caused (refer to FIG. 8A). As a result, it is possible to charge the sample in a uniform manner on a negative side. The acceleration voltage and a charging potential have a relationship as illustrated in FIG. 8B, and thus when the acceleration voltage and an irradiation time are appropriately set, it is possible to form the same charging potential as that of an actual machine (optical scanning device 1010) in an electrophotography. As an irradiation current is large, it is possible to reach a target charging potential in a short time, and thus irradiation is performed with several nano-amperes.

Then, the amount of incident electrons is lowered to 1/100 times to 1/1000 times so as to observe the electrostatic latent image.

Next, exposure is performed with respect to the photoconductor sample by using the exposure unit. The optical system of the exposure unit is adjusted so as to form a desired beam diameter and a desired beam profile. Necessary exposure energy is a factor that is determined by photoconductor characteristics, and the necessary exposure energy is, in general, approximately 2 $mJ/m^2$ to 10 $mJ/m^2$. In the photoconductor having low sensitivity, there is a case that ten and several $mJ/m^2$ is required. The charging potential or the necessary exposure energy may be set in accordance with the photoconductor characteristics or process conditions.

The exposure conditions in accordance with an actual machine (for example, the optical scanning device 1010) in the electrophotography, for example, conditions of an exposure energy density of 0.5 $mJ/m^2$ to 10 $mJ/m^2$, a beam spot diameter of 30 μm to 100 μm, a duty, an image frequency, a writing density, an image pattern, and the like may be set by using the above-described components. As the image pattern, it is possible to form various patterns such as a one-dot lattice, 2 by 2, two-dot isolation, and a line in addition to one dot isolation.

According to this, it is possible to form an electrostatic latent image on the photoconductor sample.

That is, the photoconductor sample is scanned with electron beams, secondary electrons which are emitted are detected by a secondary electron detecting unit including a scintillator, and the secondary electrons are converted into electrical signals to observe a contrast image.

In this manner, a contrast image with light and shade in which an amount of secondary electrons detected is much in the non-exposure portion, and an amount of secondary electrons detected is less in the exposure portion, is generated. A dark portion can be considered as a latent image portion due to exposure.

When a charge distribution occurs on a sample surface, an electric field distribution according to a surface charge distribution occurs in a space. According to this, the secondary electrons which are generated in accordance with the incident electrons are pushed back due to the electric field, and thus an amount of the secondary electrons which reach a detector decreases. Accordingly, at a charge leakage site, the exposure portion colors black, and the non-exposure portion colors white, and thus it is possible to measure a contrast image in correspondence with the surface charge distribution.

Figure 9A:
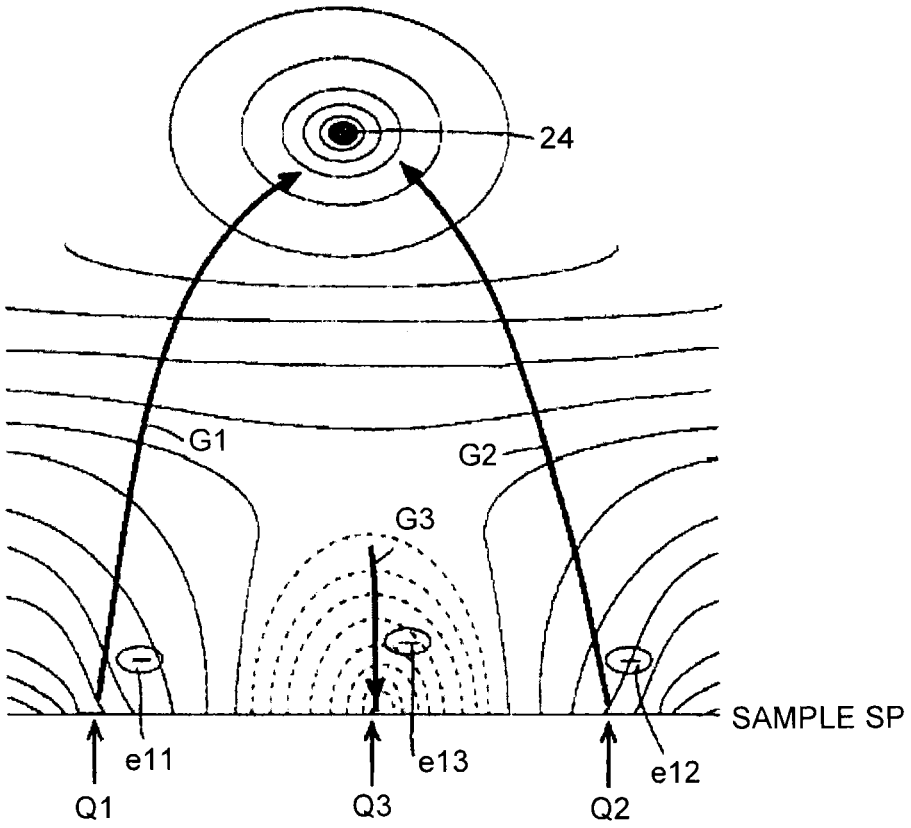
FIGS. 9A and 9B are principle models for detection of a charge distribution and a potential distribution by secondary electrons, respectively.

FIG. 9A illustrates a potential distribution in a space between a charged particle trapping device 24 and a sample SP with contour line display. The surface of the sample SP enters a state of being uniformly charged with a negative polarity except for a portion in which a potential is reduced due to optical attenuation, and a potential with a positive polarity is applied to the charged particle trapping device 24. Accordingly, in "potential contour line groups indicated by a solid line", as it is close to the charged particle trapping device 24 from the surface of the sample SP, a "potential becomes high".

Accordingly, secondary electrons el1 and el2, which are generated at a Q1 point or a Q2 point in the drawing which is a "portion that is uniformly charged with a negative polarity" in the sample SP, are attracted by a positive potential of the charged particle trapping device 24, are displaced as illustrated by an arrow G1 or an arrow G2, and are trapped by the charged particle trapping device 24.

Figure 9B:
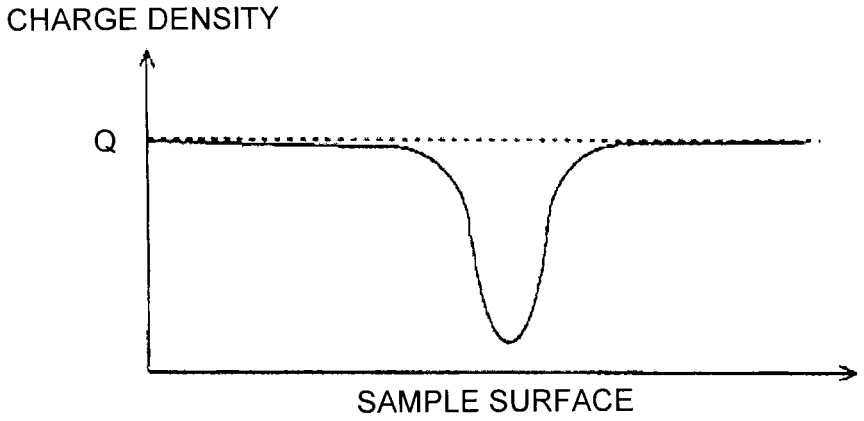
Figure 10A:
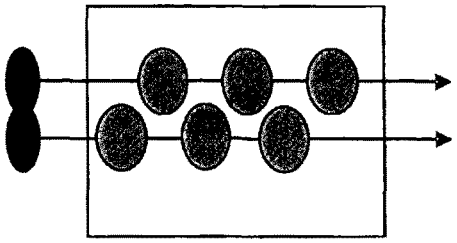
FIGS. 10A to 10D are views (first to fourth views) illustrating a latent image pattern that is formed by the optical scanning device.
Figure 10B:
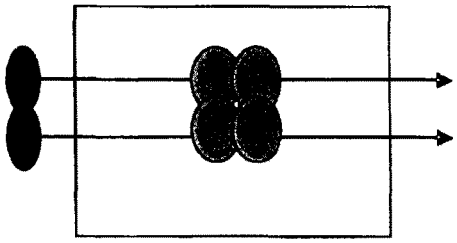
Figure 10C:
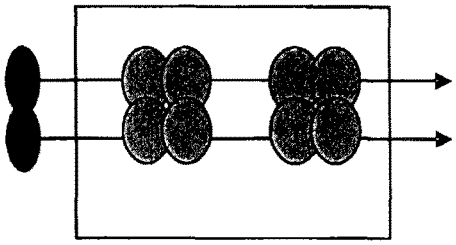
Figure 10D:
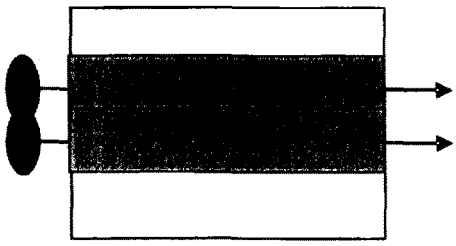

On the other hand, in FIG. 9A, a Q3 point is a "portion which is subjected to optical irradiation and in which a negative potential is attenuated", and arrangement of potential contour lines is similar to "arrangement indicated by a broken line" in the vicinity of the Q3 point, and in a potential distribution at this portion, "as it is close to the Q3 point, the potential increases". In other words, in secondary electrons e13 which are generated in the vicinity of the Q3 point, as indicated by an arrow G3, an electric force of restricting the secondary electrons toward the sample SP side operates. Accordingly, the secondary electrons e13 are trapped in a "potential hole" indicated by a potential contour line of a broken line, and are not moved toward the charged particle trapping device 24. FIG. 9B schematically illustrates the "potential hole".

That is, with regard to a vector of the secondary electrons (the number of secondary electrons) which are detected by the charged particle trapping device 24, a portion with a large vector corresponds to a "ground portion (a uniformly and negatively charged portion, a portion represented by the point Q1 or the point Q2 in FIG. 9A) of the electrostatic latent image", and a portion with a small vector corresponds to an image portion (a portion subjected to optical irradiation, a portion represented by the point Q3 in FIG. 9A) of the electrostatic latent image".

Accordingly, when sampling an electrical signal that can be obtained by the secondary electron detecting unit at the signal processing unit for an appropriate sampling time, as described above, a surface potential distribution V(X, Y) can be specified for each "minute region corresponding to the sampling" with a sampling time T set as a parameter. Accordingly, when the surface potential distribution (potential contrast image): V(X, Y) is configured as two-dimensional image data by using the signal processing unit, and the image data is output by using an output device, it is possible to obtain the electrostatic latent image as a visual image (refer to FIGS. 10A to 10D).

For example, when expressing the vector of the trapped secondary electrons with "intensity of brightness", a contrast, in which an image portion of the electrostatic latent image is dark and a ground portion is bright, is obtained, and thus it is possible to express (output) an image with light and shade which corresponds to the surface charge distribution. In addition, when the surface potential distribution is known, it is also possible to know a surface charge distribution.

It is possible to perform measurement with further higher accuracy by measuring a profile of the surface charge distribution or the surface potential distribution.

Figure 11:
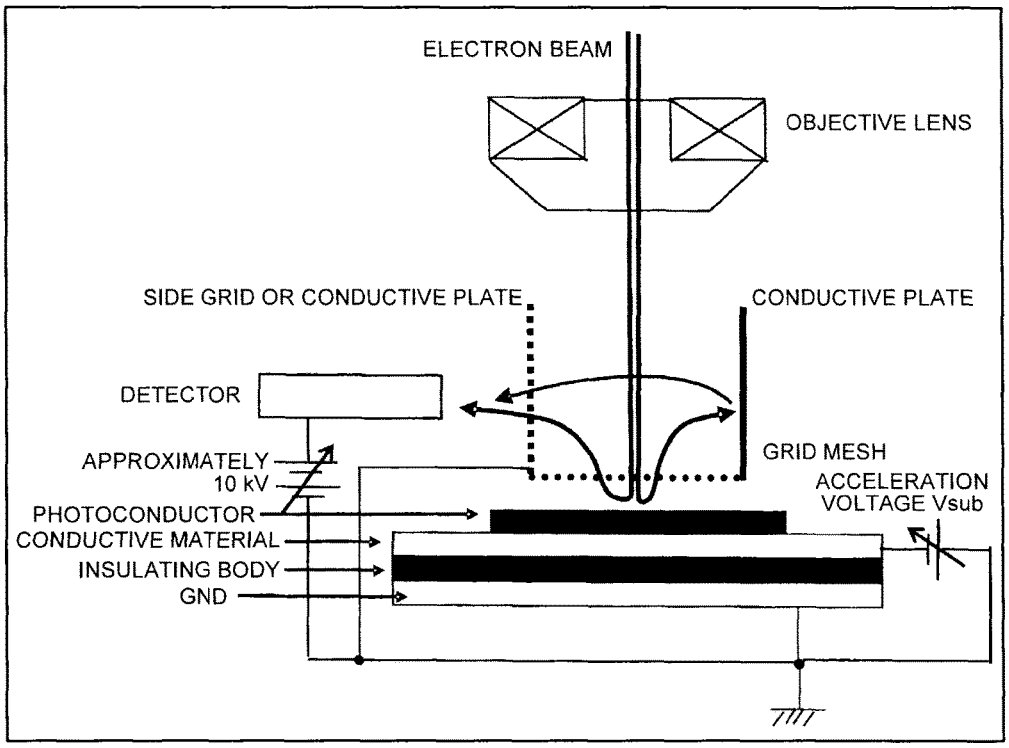
FIG. 11 is a view illustrating a measurement example through grid mesh arrangement.

FIG. 11 illustrates another example of the electrostatic latent image measuring device.

A voltage application unit, which is capable of applying a voltage ±Vsub, is connected to the sample installation unit on a lower side of the photoconductor sample. In addition, a grid mesh is disposed on an upper side of the photoconductor sample so as to suppress an effect of a sample charge on incident electron beams.

Figure 12A:
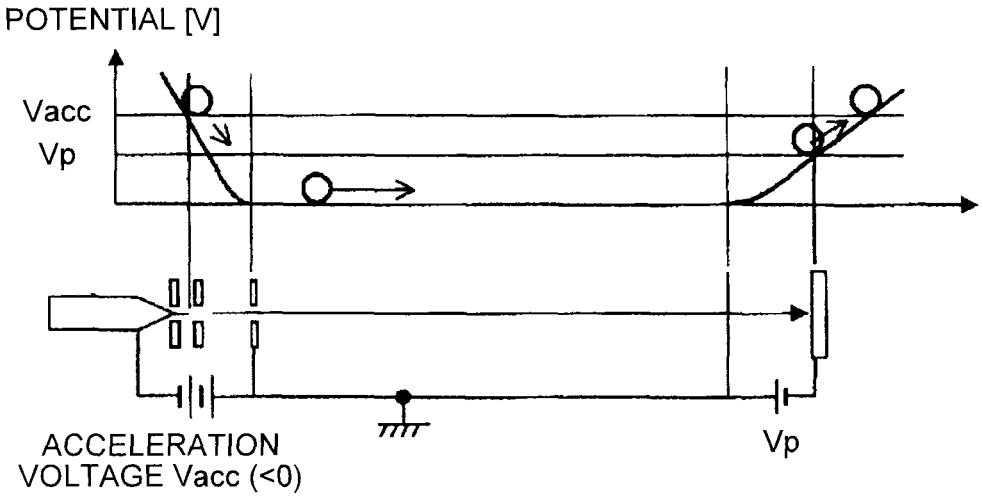
FIGS. 12A and 12B are views (first and second views) illustrating a relationship between a potential and an acceleration voltage.
Figure 12B:
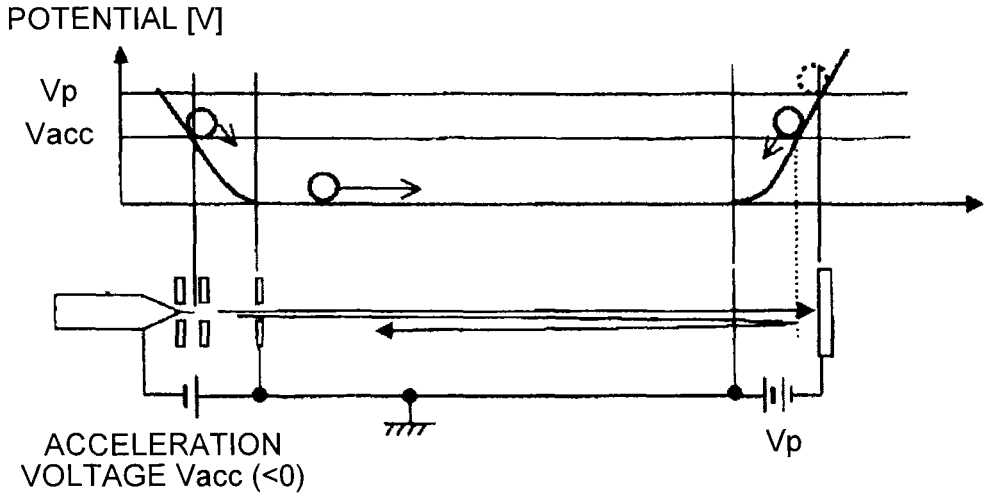

FIGS. 12A and 12B are views illustrating a relationship between an incident electron and a sample. FIG. 12A illustrates a case where the acceleration voltage is greater than a surface potential, and FIG. 12B illustrates a case where the acceleration voltage is smaller than the surface potential.

A region with a state, in which a velocity vector of the incident charged particles in a vertical direction of the sample is inverted before reaching the sample, exists for a configuration of detecting primary incident charged particles.

In addition, the acceleration voltage is typically expressed with "positive". However, an application voltage Vacc of the acceleration voltage is negative, and is expressed with "negative" for physical meaning as a potential. Here, the acceleration voltage is expressed with "negative" (Vacc<0) for ease of explanation. The acceleration potential of electron beams is set to Vacc (<0), and the potential of the sample is set to Vp (<0).

The potential is electrical potential energy of a unit charge. Accordingly, an incident electron is moved at a velocity corresponding to the acceleration voltage Vacc at a potential of 0 (V). That is, when a charge amount of the electron is set as "e", and the mass of the electron is set as "m", an initial velocity $v_0$ of the electron is expressed as $mv_0^2/2=e\times|Vacc|$. In a region in which movement of the acceleration voltage does not function in vacuo due to the energy conservation raw, the incident electron is moved at a constant velocity, and as it is close to the sample surface, a potential is raised, and thus velocity that is affected by coulomb repulsion of sample charges is lowered.

Accordingly, the following phenomenon occurs typically.

In FIG. 12A, a relationship of |Vacc|≥|Vp| is satisfied, and thus a velocity of an electron is reduced, but the electron reaches the sample. In FIG. 12B, in a case where a relationship of |Vacc|<|Vp| is satisfied, the velocity of the incident electron is affected by the potential of the sample, and is gradually decelerated. A velocity before reaching the sample becomes zero, and thus the incident electron is moved in an opposite direction.

In vacuo in which air resistance is not present, the energy conservation raw is established in an approximately complete manner. Accordingly, it is possible to measure a surface potential by measuring conditions in which energy on the sample surface when energy of the incident electron is changed, that is, landing energy becomes approximately zero. Here, it is assumed that a primary inverted charged particle, particularly, an electron is called a primary inverted electron. In the secondary electron and the primary inverted charged particle which occur when reaching the sample, amounts of the secondary electrons and the primary inverted charged particles which reach a detector are greatly different from each other, and thus it is possible to identify the secondary electrons and the primary inverted charged particles from a contrast boundary of light and shade.

In addition, a scanning electron microscope and the like are provided with a reflected electron detector. In this case, typically, the reflected electron represents an electron that is incident is reflected (scattered) to a backward rear surface due to cooperation with a material of the sample and jumps out from the sample surface. Energy of the reflected electron is equivalent to energy of the incident electron. It can be said that a vector of the reflected electron increases as an atomic number of the sample becomes larger. Accordingly, the vector is used in a detection method of ascertaining a difference and unevenness in a composition of the sample. In contrast, the primary inverted electron is inverted before reaching the sample surface due to an effect of a potential distribution on the sample surface, and exhibits a totally different phenomenon.

Figure 13:
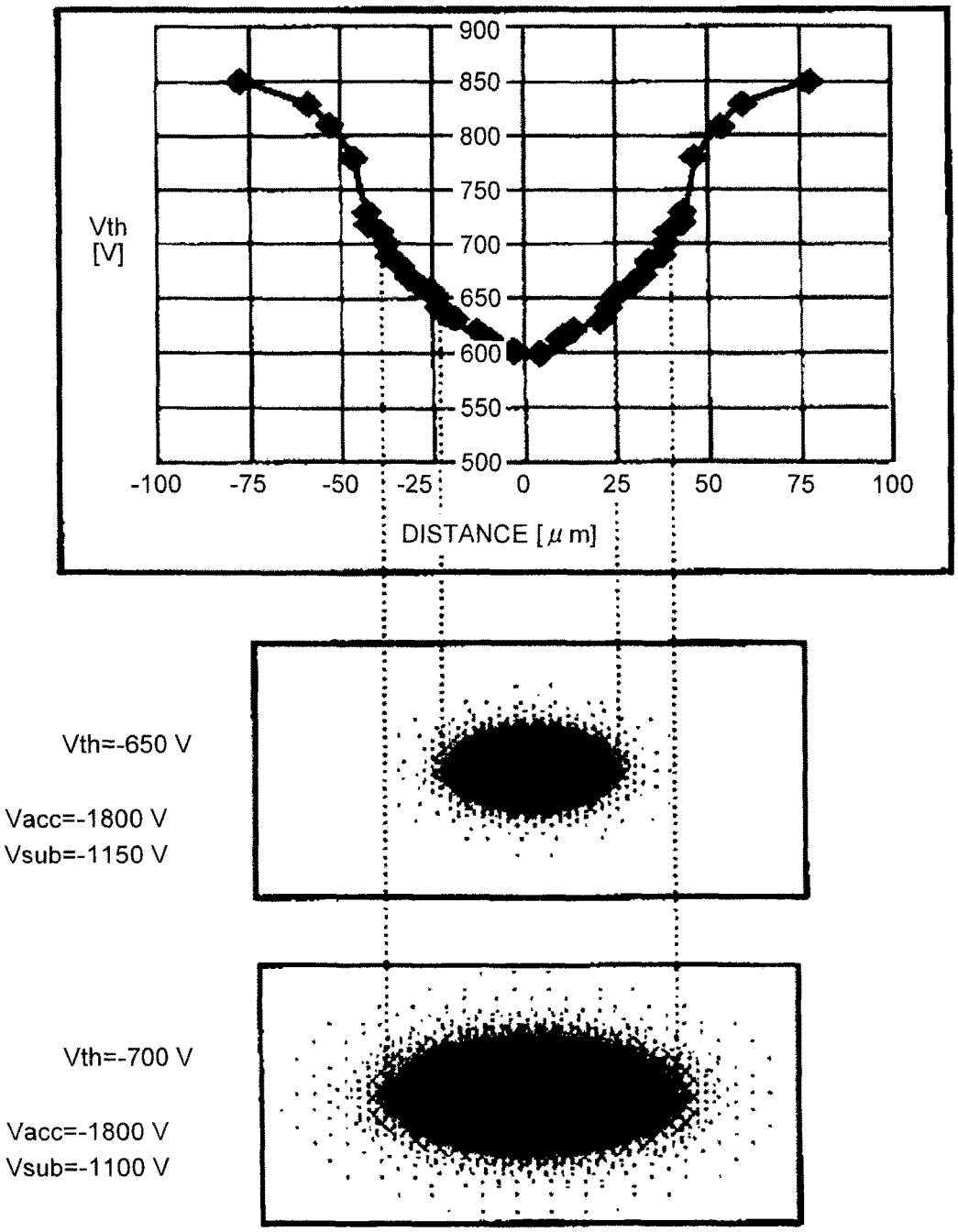
FIG. 13 is a view illustrating an example of a latent image depth measurement result.

FIG. 13 illustrates an example of a latent image depth measurement result. At each scanning position (x, y), when a difference between the acceleration voltage Vacc and the voltage Vsub that is applied to a lower side of the sample is set as Vth (=Vacc−Vsub), a potential distribution V(x, y) can be measured through measurement of Vth(x, y) when the landing energy becomes approximately zero. Vth(x, y) has a unique corresponding relationship with the potential distribution V(x, y), and thus in a gradual charge distribution, Vth(x, y) is approximately equivalent to the potential distribution V(x, y).

A curve in an upper section of FIG. 13 represents an example of a surface potential distribution which occurs due to the charge distribution on the sample surface. The acceleration voltage of an electron gun which performs two-dimensional scanning is set to −1800 V. A potential at the center (a coordinate of the horizontal axis=0) is approximately −600 V. As it goes toward an outer side from the center, the potential increases in a negative direction. Accordingly, a potential of a peripheral region in which a radius from the center exceeds 75 μm is approximately −850 V.

An elliptical shape in an intermediate section of FIG. 13 is a view obtained by imaging an output of a detector when a rear surface of the sample is set to Vsub of −1150 V. At this time, a relationship of Vth=Vacc−Vsub=−650 V is satisfied.

An elliptical shape in a lower section of FIG. 13 is obtained by imaging the output of the detector under the same conditions as described above except that Vsub is set to −1100 V. At this time, Vth is set to −700 V. Accordingly, it is possible to measure surface potential information of the sample by scanning the sample surface with electrons while changing the acceleration voltage Vacc or the application voltage Vsub and by measuring a distribution of Vth.

When using this method, it is possible to visualize the latent image profile in the order of micrometers which is difficult to realize in the related art.

In a method of measuring the latent image profile with primary inverted electrons, energy of an incident electron varies to an extreme degree, and thus an orbit of the incident electron deviates. As a result, a scanning magnification may vary, or distortion aberration may be caused. In this case, an electrostatic field environment or an electron orbit is calculated in advance, and correction is performed on the basis of the calculation. According to this, it is possible to perform measurement with further higher accuracy.

In this manner, it is actually possible to measure a latent image charge distribution, a surface potential distribution, an electric field intensity distribution, an electric field vector in a perpendicular direction of the sample with high accuracy.

However, recently, a demand for speeding-up during formation of an image has increased with respect to a multi-color image forming apparatus, and the image forming apparatus has been used as an on-demand printing system for simple printing. Accordingly, there is a demand for high-quality and high-accuracy of an image.

As a problem relating to image formation by using an electrophotographic type image forming apparatus, reproducibility of a pattern which is isolated (hereinafter, also referred to as an isolated pattern) may be exemplified. Particularly, in an image that is formed with resolution of 600 dpi on the basis of an isolated pattern having a size equal to or less than one dot, a concentration may be further reduced, or an area becomes smaller in comparison to a target image. Accordingly, in order to carry out formation of an image with high quality, excellent reproducibility is demanded even in the formation of the isolated pattern.

In the electrophotographic type image forming apparatus, the good or bad of results in respective processes including charging, exposure, developing, transfer, and fixing has a great effect on the quality of an image that is finally output. Particularly, a state of an electrostatic latent image that is formed on the photoconductor through the exposure process is very important factor that has a direct effect on the behavior of toner particles. As a result, an improvement in the electrostatic latent image, which is formed on the photoconductor through the exposure, is very important factor for formation of an image with high quality.

Hereinafter, description will be given of a method of forming an image on the basis of image data including an isolated pattern by using the laser printer 1000 of this embodiment.

Figure 14A:
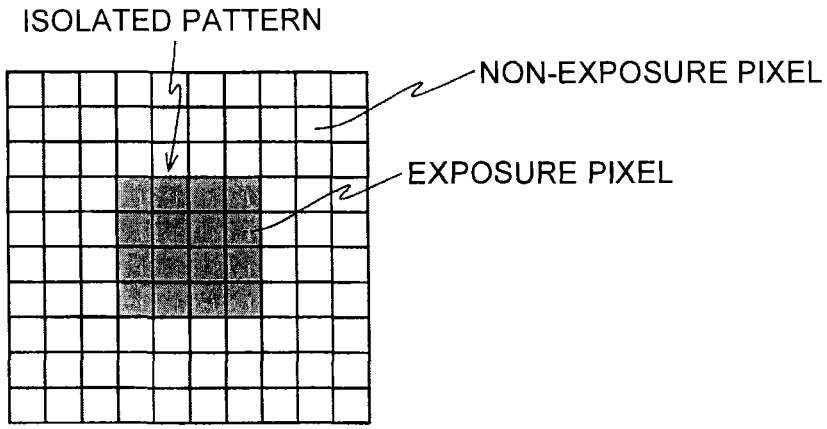
FIGS. 14A and 14B are views (first and second views) illustrating an isolated pattern.
Figure 14B:
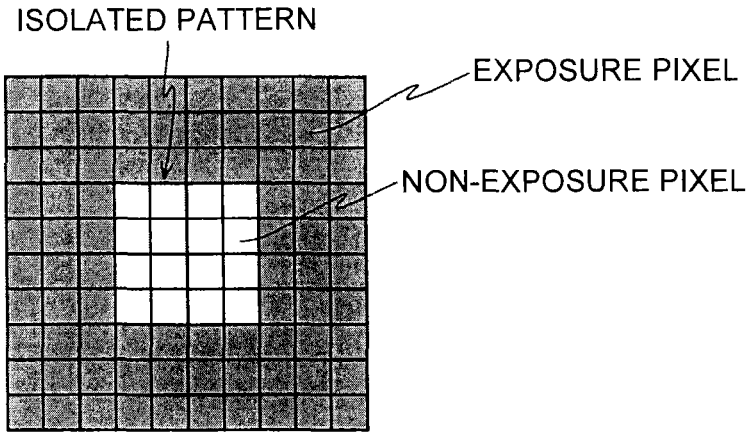

FIG. 14A illustrates an isolated pattern constituted by a plurality exposure pixels (for example, 16 exposure pixels), and FIG. 14B illustrates an isolated pattern constituted by a plurality of non-exposure pixels (for example, 16 non-exposure patterns). That is, the "isolated pattern" represents an exposure region (a black region) constituted by a plurality of exposure pixels surrounded by a peripheral region that is a non-exposure region (a white region) constituted by a plurality of non-exposure pixels, or a non-exposure region (a white region) constituted by a plurality of non-exposure pixels surrounded by a peripheral region that is an exposure region (a black region) constituted by a plurality of exposure pixels.

Figure 15A:
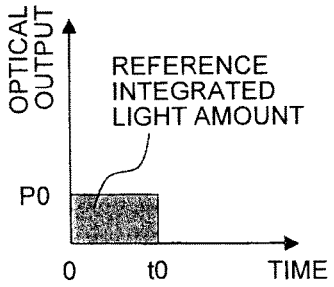
FIGS. 15A to 15C are views (first to third views) illustrating an integrated light amount.

Here, when forming an electrostatic latent image on a photoconductor drum with light from a light source, for example, as illustrated in FIG. 15A, a portion on the surface of the photoconductor drum, which corresponds to the exposure region, is uniformly exposed for a predetermined time (t0) with a predetermined optical output value (P0). That is, an exposure amount with respect to each exposure pixel of the exposure region is set to be uniform. The exposure amount with respect to each exposure pixel is a time-integration value of an optical output value (exposure intensity) with respect to the exposure pixel. In a case where the optical output value is constant, the exposure amount becomes the product of the optical output value and the exposure time.

In addition, a total exposure amount (total exposure energy) with respect to the exposure region constituted by the plurality of exposure pixels, that is, the time-integration value of the optical output value (exposure intensity) is defined as an "integrated light amount". In a case where an optical output value is constant, the "integrated light amount" becomes the product of the optical output value and the total exposure time. Particularly, as illustrated in FIG. 15A, an integrated light amount when the optical output value is a predetermined optical output value (P0) and the total exposure time is a predetermined time (t0) is referred to as a "reference integrated light amount".

Figure 15B:
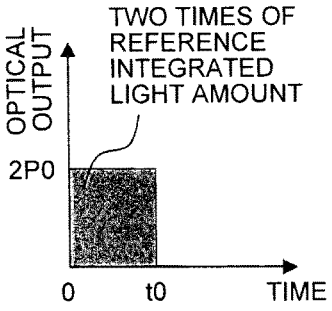
Figure 15C:
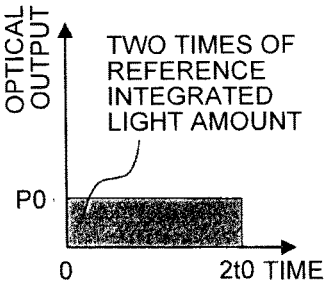

For example, when forming an electrostatic latent image corresponding to an exposure region having the same area as in FIG. 15A, in a case where only the optical output value is increased two times as illustrated in FIG. 15B, or in a case where only the exposure time is lengthened two times as illustrated in FIG. 15C, an integrated light amount, which is two times the reference integrated light amount, is obtained.

Figure 16A:
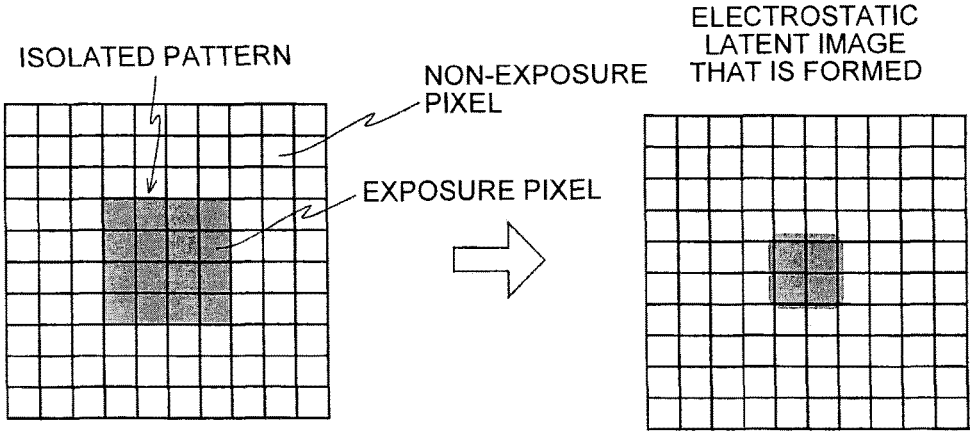
FIGS. 16A and 16B are views illustrating an exposure amount of each exposure pixel in an isolated pattern of Comparative Example 1 and Example 1, and an electrostatic latent image on a photoconductor drum which corresponds to the isolated pattern.

Similar to Comparative Example 1 as illustrated in FIG. 16A, in a case where an exposure amount with respect to each exposure pixel of an isolated pattern including a plurality of exposure pixels (for example, 16 exposure pixels) is set to be the same in each case, an electrostatic latent image corresponding to the isolated pattern is formed in a smaller size in comparison to a target electrostatic latent image. In addition, after an electrostatic latent image is formed on the basis of the isolated pattern, the electrostatic latent image can be measured by the above-described electrostatic latent image measuring device.

Figure 16B:
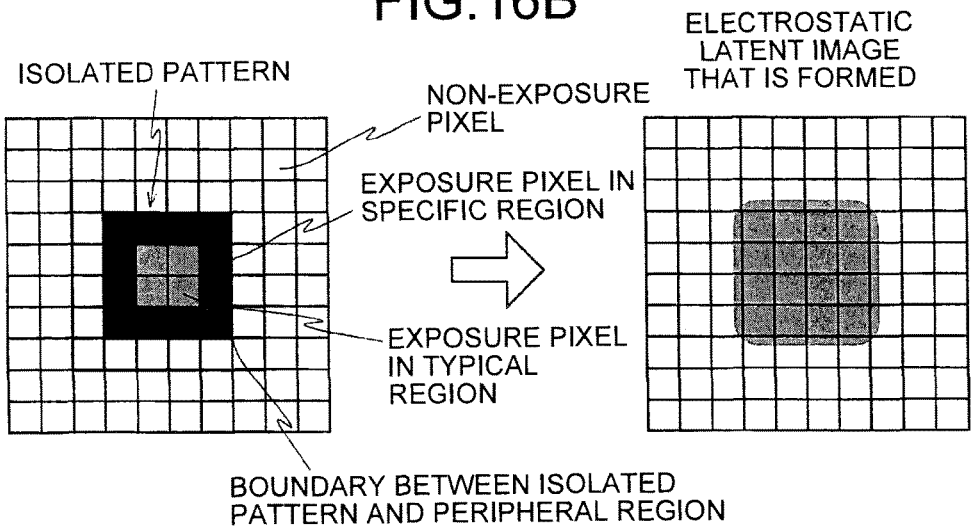

Therefore, in Example 1 illustrated in FIG. 16B, in a case where the isolated pattern is constituted by a plurality of exposure pixels (for example, 16 exposure pixels), the exposure amount setting unit 1060*b* detects a specific region which is adjacent to a boundary between the isolated pattern and a peripheral region of the isolated pattern and is constituted by a plurality of exposure pixels in the isolated pattern, and sets an exposure amount with respect to each exposure pixel in the specific region to be greater than an exposure amount with respect to each exposure pixel in the region (hereinafter, also referred to as a typical region) other than the specific region in the isolated pattern. As a result, an electrostatic latent image corresponding to the isolated pattern is formed in a size that is approximately equal to that of a target electrostatic latent image. In addition, the exposure amount setting unit 1060*b* determines whether or not the isolated pattern is constituted by a plurality of exposure pixels or a plurality of non-exposure pixels on the basis of image data transmitted from the image processing unit 1060*a*.

Here, the "specific region" represents a square frame-shaped region (a black portion having a one-pixel width in FIG. 16B) constituted by 12 exposure pixels which surround the typical region (a square gray portion in FIG. 16B in which one side has a two-pixel width) constituted by four central exposure pixels in the isolated pattern.

In addition, in Example 1, the isolated pattern is set as the square pattern constituted by 16 exposure pixels, but there is no limitation thereto. For example, a square pattern constituted by 36 or more exposure pixels is also possible. In this case, the "specific region" may be set to be equal or greater than a two-pixel width, and the "typical region" may be set to be equal to or greater than a three-pixel width. In addition, the shape of the isolated pattern may be a shape other than the square shape.

Figure 17A:
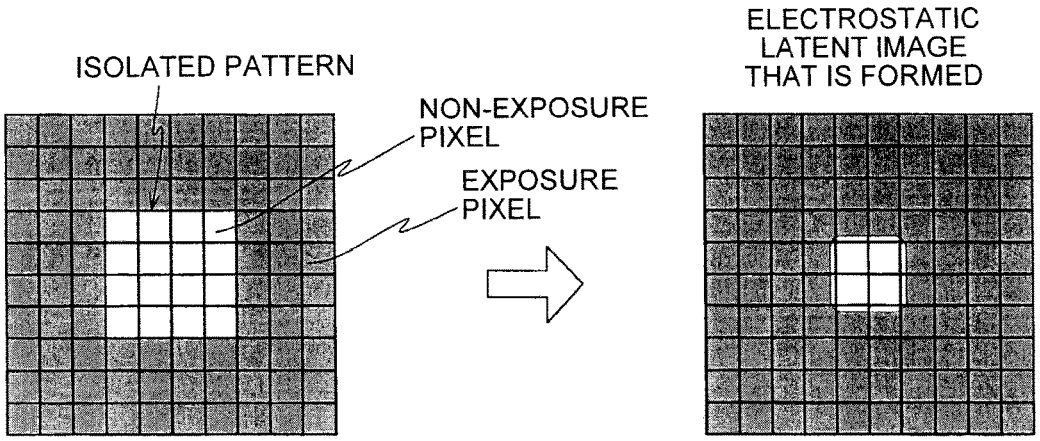
FIGS. 17A and 17B are views illustrating an exposure amount of each exposure pixel in an isolated pattern of Comparative Example 2 and Example 2, and an electrostatic latent image on a photoconductor drum which corresponds to the isolated pattern.

Similar to Comparative Example 2 illustrated in FIG. 17A, in a case where the exposure amount with respect to each exposure pixel in the peripheral region constituted by a plurality of exposure pixels is set to be the same in each case, an electrostatic latent image corresponding to the isolated pattern is formed in a smaller size in comparison to a target electrostatic latent image.

Figure 17B:
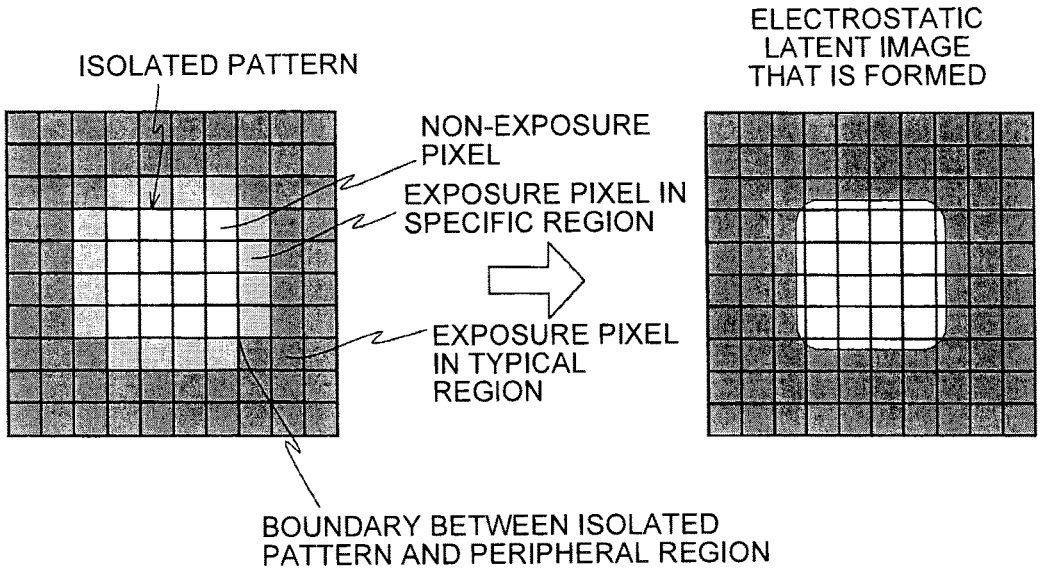

Therefore, in Example 2 illustrated in FIG. 17B, in a case where the isolated pattern is constituted by a plurality of non-exposure pixels (for example, 16 non-exposure pixels), the exposure amount setting unit 1060*b* detects a specific region which is adjacent to a boundary between the isolated pattern and a peripheral region of the isolated pattern and is constituted by a plurality of exposure pixels in the peripheral region, and sets an exposure amount with respect to each exposure pixel in the specific region to be less than an exposure amount with respect to each exposure pixel in a region (hereinafter, also referred to as a typical region) other than the specific region in the peripheral region. As a result, an electrostatic latent image corresponding to the isolated pattern is formed in a size that is approximately equal to that of a target electrostatic latent image. In addition, the exposure amount setting unit 1060*b* determines whether or not the isolated pattern is constituted by a plurality of exposure pixels or a plurality of non-exposure pixels on the basis of image data transmitted from the image processing unit 1060*a*.

Here, the "specific region" is constituted by 16 exposure pixels (a light-gray portion having a one-pixel width in FIG. 17B), which surround the isolated pattern, in the peripheral region, and the "typical region" is constituted by a region (a dark-gray portion with a width of a plurality of pixels in FIG. 17B) other than the specific region in the peripheral region.

In addition, in Example 2, the isolated pattern is set as the square pattern constituted by 16 non-exposure pixels, but there is no limitation thereto. For example, a square pattern constituted by 4 or 36 or more non-exposure pixels is also possible.

In addition, in Example 2, the "specific region" is set to have a one-pixel width, but may be set to be equal to or greater than a two-pixel width. In addition, the shape of the isolated pattern may be a shape other than the square shape.

Here, particularly, in a case where the isolated pattern is a minute pattern constituted by a plurality of exposure pixels, that is, an area of the isolated pattern constituted by the plurality of exposure pixels is equal to or less than a first reference area (for example, an area of one pixel at resolution of 600 dpi), it is desirable that an integrated light amount with respect to the specific region in the isolated pattern be set to be greater than an integrated light amount (for example, the reference integrated light amount) with respect to the typical region in the isolated pattern so as to form a target electrostatic latent image. In addition, the area of the isolated pattern is "the number of pixels in the isolated pattern/resolution".

Figure 18:
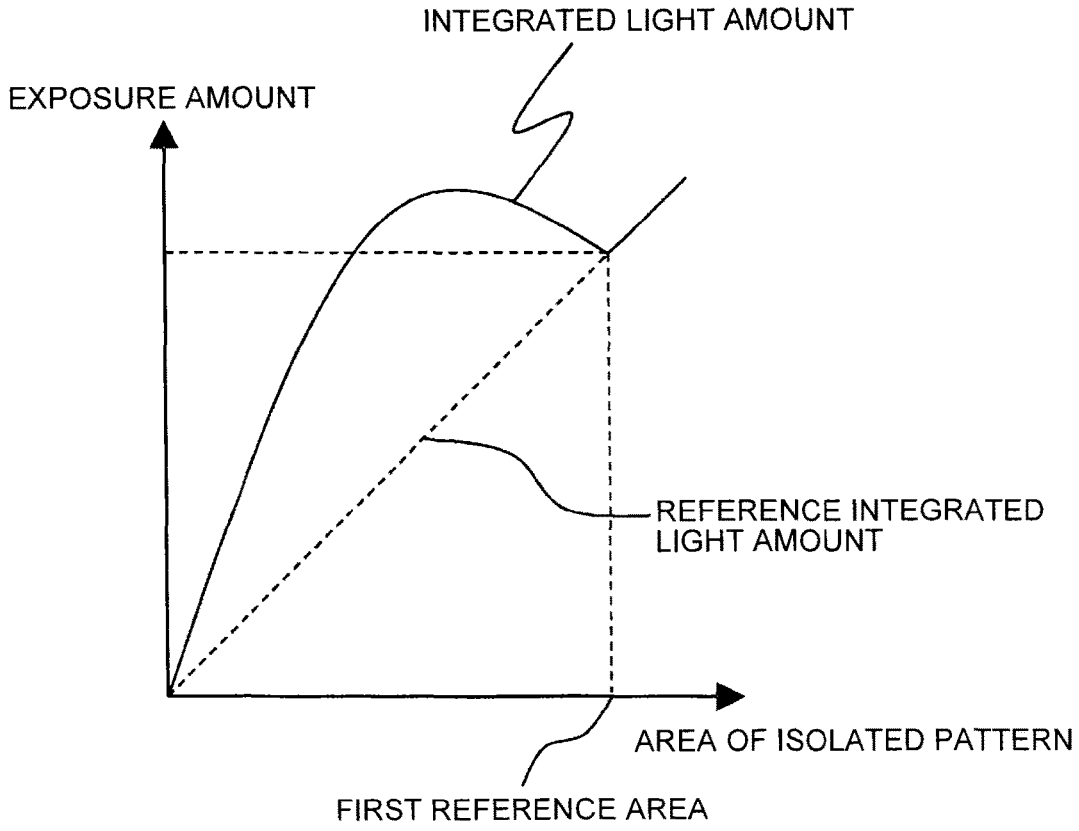
FIG. 18 is a view illustrating an integrated light amount of Comparative Example 3.

However, the reference integrated light amount increases in proportion to the area of the isolated pattern (the number of pixels at predetermined resolution) (refer to FIG. 18).

Similar to Comparative Example 3 illustrated in FIG. 18, in a case where the area of the isolated pattern is equal to or less than the first reference area, if changing the integrated light amount with respect to the specific region to a value that is equal to or greater than an integrated light amount (for example, the reference integrated light amount) with respect to the typical region and in a curved shape having an extreme value regardless of the area of the isolated pattern, reversal (reversal in a concentration) of the integrated light amount occurs with an area having the extreme value set as a boundary.

In this case, a balance between the area (the product of an area of one pixel of the isolated pattern and the number of pixels) of the isolated pattern to be emphasized and the integrated light amount that corresponds thereto is not appropriate. Accordingly, thus there is a concern that the isolated pattern may be emphasized more than necessary, and thus the exposure amount is not sufficient, and a dot is not reproduced.

Figure 19:
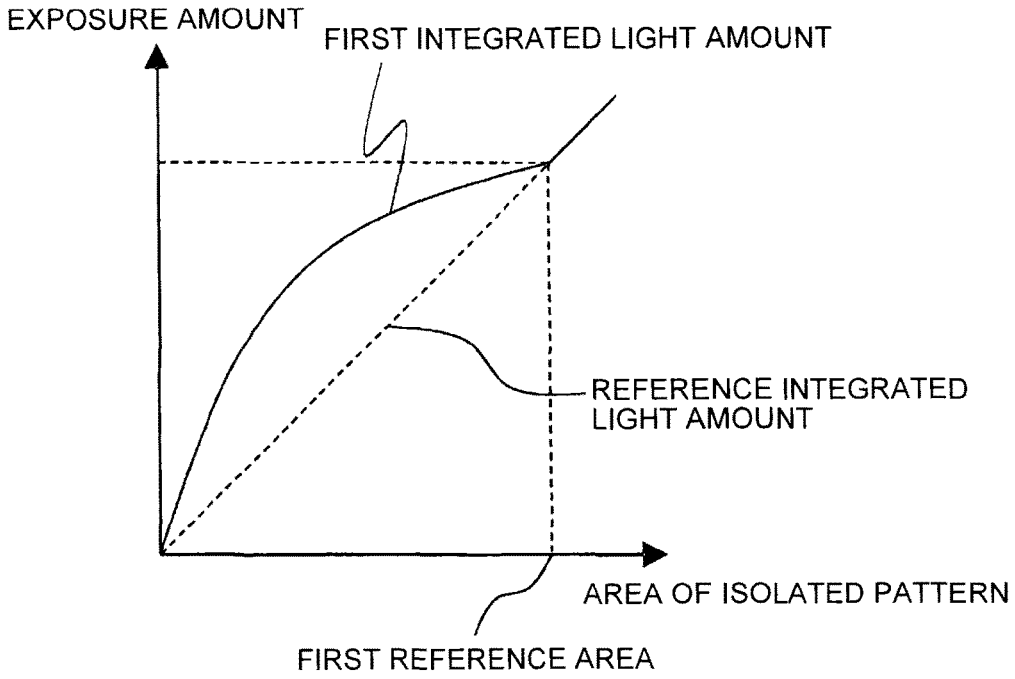
FIG. 19 is a view illustrating an integrated light amount (a first integrated light amount) of Example 3.

Therefore, in Example 3 illustrated in FIG. 19, in a case where the area of the isolated pattern is equal to or less than the first reference area, a first integrated light amount that is an integrated light amount with respect to the specific region is changed to be equal to or greater than the integrated light amount (for example, the reference integrated light amount) with respect to the typical region regardless of the area of the isolated pattern, and to monotonically increase with respect to an increase in the area of the isolated pattern (an increase in the number of pixels) (for example, in a curved shape, a linear shape, a polygonal line shape, and the like). According to this, it is possible to prevent the reversal of the integrated light amount with respect to the increase in the area of the isolated pattern.

However, in a case where the area of the isolated pattern is equal to or less than the first reference area (for example, an area of one pixel at resolution of 600 dpi), if exposure is performed with the first integrated light amount which is greater than the reference integrated light amount and monotonically increases with respect to the increase in the area of the isolated pattern, it is known that an electrostatic latent image close to a target electrostatic latent image can be formed. However, in a case where the area of the isolated pattern is equal to or less than a second reference area (for example, an area of one pixel at resolution of 1200 dpi), if exposure is performed with a second integrated light amount that is two or more times (preferably, two times to three times) the reference integrated light amount, it is known that it is possible to form an electrostatic latent image that is particularly close to a target image. In addition, when the second integrated light amount becomes 1.1 or more times the reference integrated light amount, it is known that an image quality improvement effect begins to appear.

Figure 20:
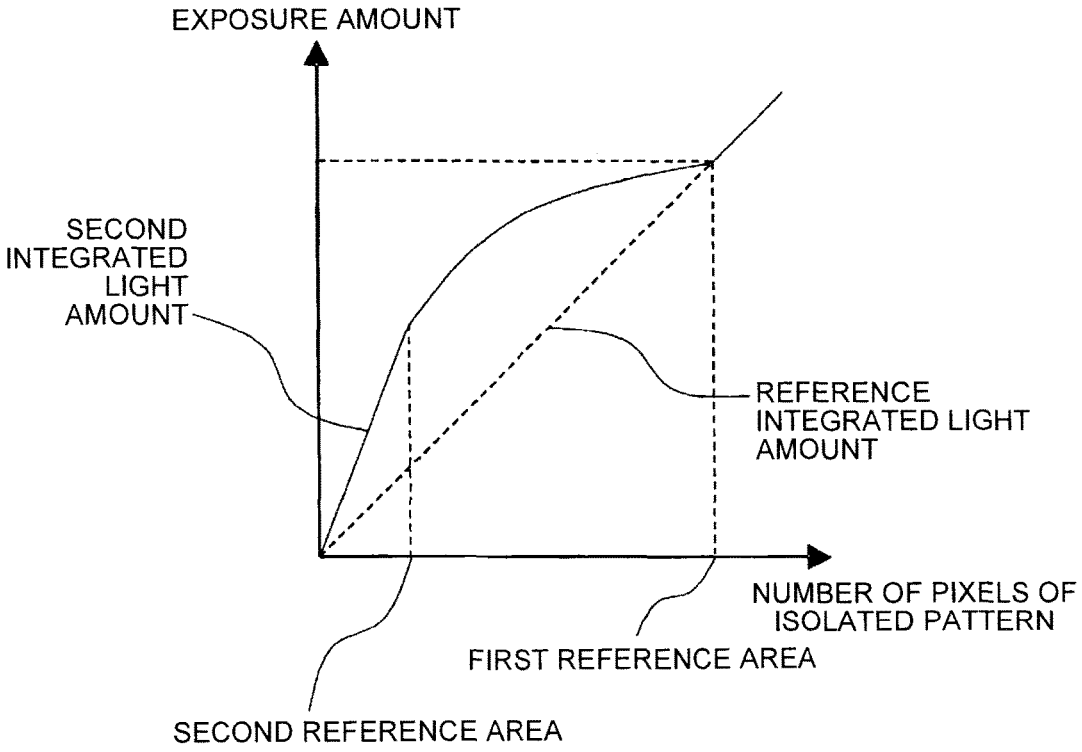
FIG. 20 is a view illustrating an integrated light amount (a second integrated light amount) of Example 4.

Therefore, in Example 4 illustrated in FIG. 20, in a case where the area of the isolated pattern is equal to or less than the second reference area that is smaller than the first reference area, the second integrated light amount that is an integrated light amount with respect to the specific region in the isolated pattern is set to an integrated light amount that is two or more times the integrated light amount (for example, the reference integrated light amount) with respect to the typical region in the isolated pattern.

Here, particularly, in a case where the isolated pattern is a minute pattern constituted by a plurality of non-exposure pixels, if the area of the isolated pattern constituted by the plurality of non-exposure pixels is equal to or less than the first reference area (for example, an area of one pixel at resolution of 600 dpi), it is preferable that the integrated light amount with respect to the specific region in the peripheral region be set to be less than the integrated light amount (for example, the reference integrated light amount) with respect to the typical region in the peripheral region so as to form a target electrostatic latent image. In addition, the area of the isolated pattern is the number of pixels in the isolated pattern/resolution.

Figure 21:
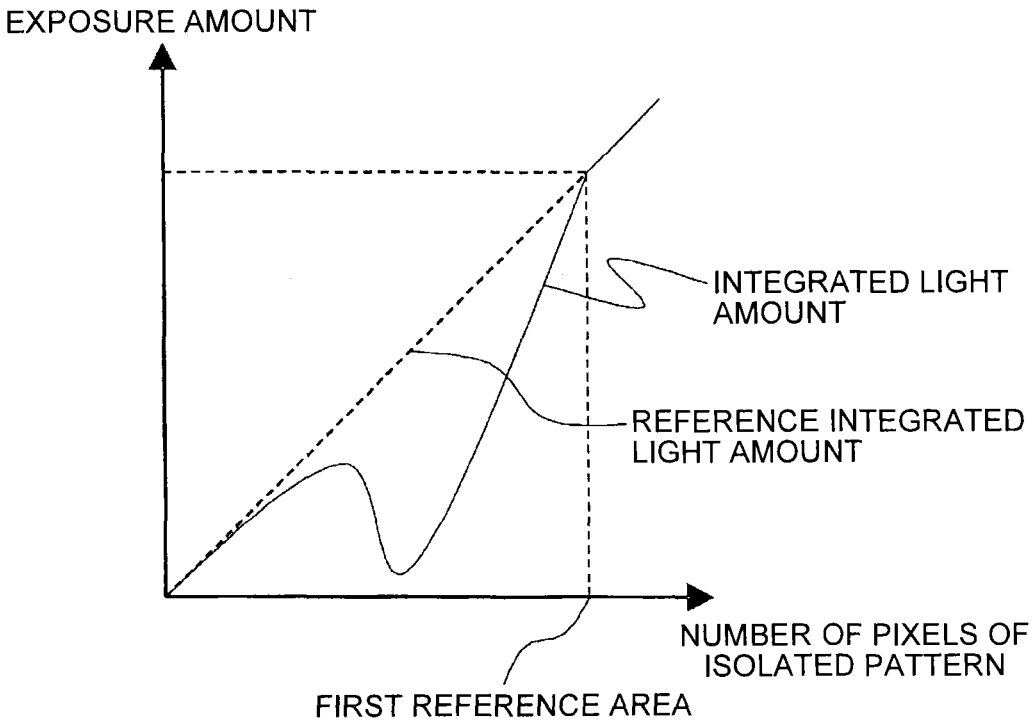
FIG. 21 is a view illustrating an integrated light amount of Comparative Example 4.

However, the reference integrated light amount increases in proportion to the area of the isolated pattern (the number of pixels at predetermined resolution) (refer to FIG. 21).

Similar to Comparative Example 4 illustrated in FIG. 21, in a case where the area of the isolated pattern is equal to or less than the first reference area, if changing the integrated light amount with respect to the specific region in the peripheral region to a value that is equal to or less than the integrated light amount (for example, the reference integrated light amount) with respect to the typical region and in a curved shape having an extreme value regardless of the area of the isolated pattern, reversal (reversal in a concentration) of the integrated light amount occurs with an area having the extreme value set as a boundary.

In this case, a balance between the area (the product of an area of one pixel of the isolated pattern and the number of pixels) of the isolated pattern to be emphasized and the integrated light amount that corresponds thereto is not appropriate. Accordingly, there is a concern that the isolated pattern may be emphasized more than necessary, and thus the exposure amount is not sufficient, and a dot is not reproduced.

Figure 22:
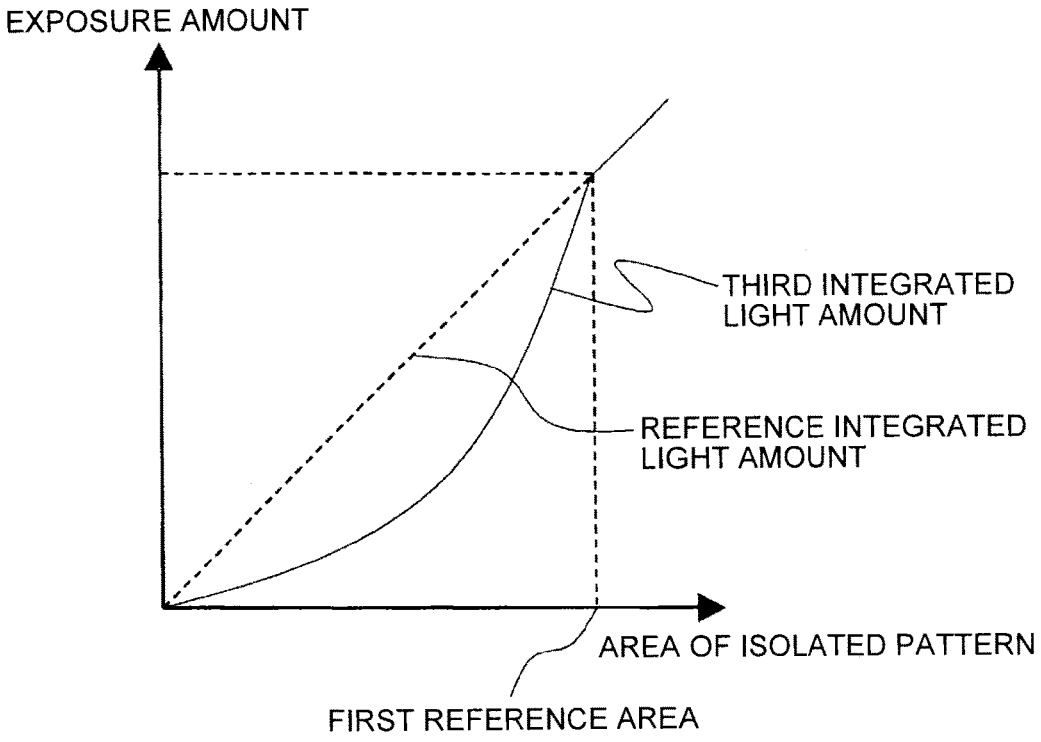
FIG. 22 is a view illustrating an integrated light amount (a third integrated light amount) of Example 5.

Therefore, in Example 5 illustrated in FIG. 22, in a case where the area of the isolated pattern is equal to or less than the first reference area, a third integrated light amount that is an integrated light amount with respect to the specific region in the peripheral region is changed to be equal to or less than the integrated light amount (for example, the reference integrated light amount) with respect to the typical region regardless of the area of the isolated pattern, and to monotonically increase with respect to an increase in the area of the isolated pattern (an increase in the number of pixels) (for example, in a curved shape, a linear shape, a polygonal line shape, and the like). According to this, it is possible to prevent the reversal of the integrated light amount with respect to the increase in the area of the isolated pattern.

However, in a case where the area of the isolated pattern is equal to or less than the first reference area (for example, an area of one pixel at resolution of 600 dpi), if exposure is performed with the integrated light amount which is less than the reference integrated light amount and monotonically increases with respect to the increase in the area of the isolated pattern, it is known that an electrostatic latent image close to a target electrostatic latent image can be formed. However, in a case where the area of the isolated pattern is equal to or less than the second reference area (for example, an area of one pixel at resolution of 1200 dpi), if exposure is performed with the second integrated light amount that is 0.8 or less times (preferably, 0.5 times to 0.7 times) the reference integrated light amount, it is known that it is possible to form an electrostatic latent image that is particularly close to a target image.

Figure 23:
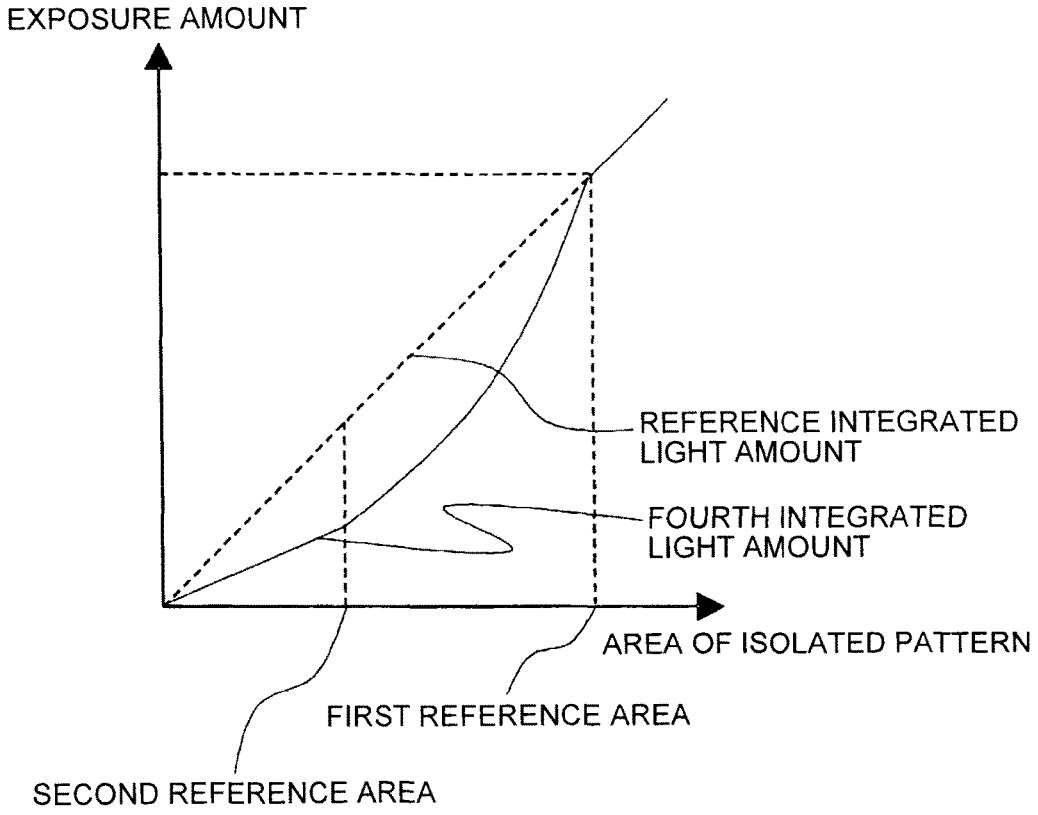
FIG. 23 is a view illustrating an integrated light amount (a fourth integrated light amount) of Example 6.

Therefore, in Example 6 illustrated in FIG. 23, in a case where the area of the isolated pattern is equal to or less than the second reference area that is smaller than the first reference area, the integrated light amount with respect to the specific region in the peripheral region is set to an integrated light amount that is 0.8 or less times the integrated light amount (for example, the reference integrated light amount) with respect to the typical region in the peripheral region.

Figure 24:
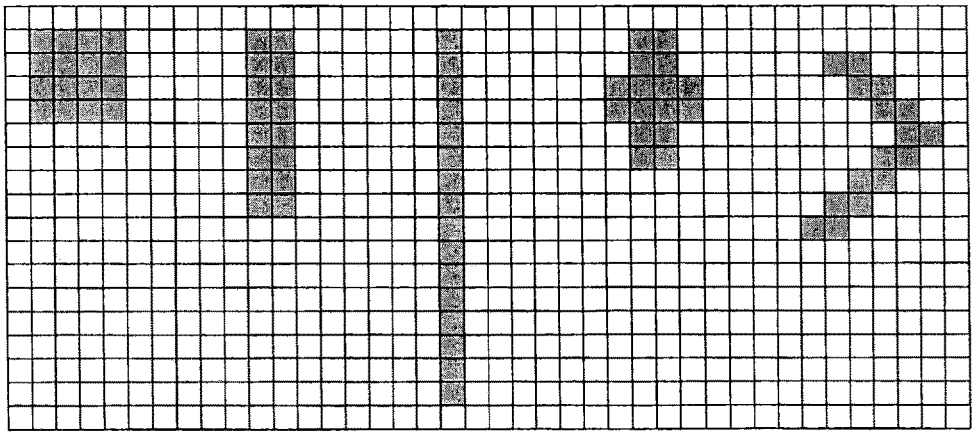
FIG. 24 is a view illustrating a specific example of the isolated pattern.
Figure 25:
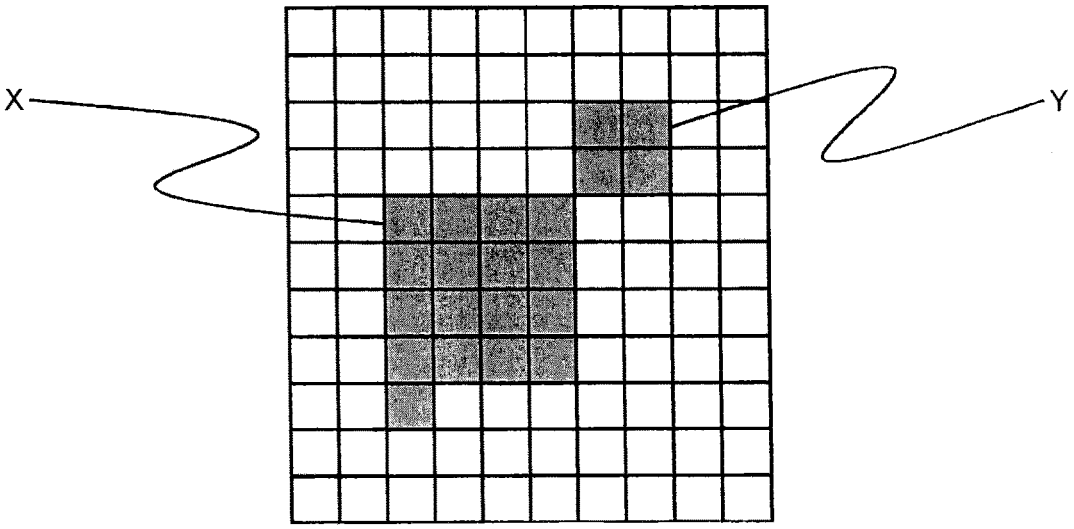
FIG. 25 is a view illustrating an example in which two isolated patterns are adjacent to each other.

FIG. 24 illustrates approximately five specific examples in which the isolated pattern (exposure portion) with an area of one pixel at 1200 dpi is expressed with resolution of 4800 dpi. In each example, each exposure pixel is adjacent to other exposure pixels at least at one or more sides. In this case, the "isolated pattern" can be defined as a pattern constituted by a plurality of exposure pixels in which each exposure pixel is adjacent to other exposure pixels at least at one or more sides.

When defining the isolated pattern as described above, in a case illustrated in FIG. 25, it is possible to ascertain that two isolated patterns X and Y are adjacent to each other at the apex of one pixel.

On the other hand, in a case where the isolated pattern is a non-exposure portion, the "isolated pattern" can be defined as a pattern constituted by a plurality of non-exposure pixels in which each non-exposure pixel is adjacent to other non-exposure pixels at least at one or more sides.

Figure 26A:
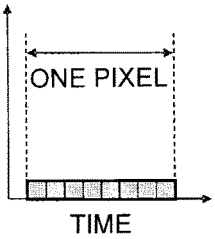
FIG. 26A is a view illustrating an exposure method of the related art.
Figure 26B:
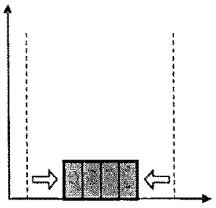
FIGS. 26B to 26D are views (first to third views) illustrating TC exposure, respectively.
Figure 26C:
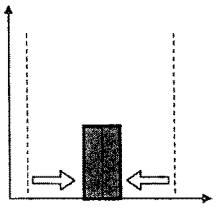
Figure 26D:
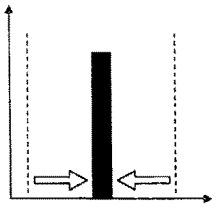

Here, in the case of exposing the specific region to be emphasized with respect to the typical region, an exposure method in the related art as illustrated in FIG. 26A may be used, but a TC exposure method as illustrated in FIGS. 26B to 26D may also be used.

The TC exposure (time concentration exposure) is an exposure method in which exposure is performed with a strong optical output in a short lighting time in a temporally focused manner, and has an effect of improving latent image resolution without changing a beam size. When using this method, it is possible to have the degree of freedom for adjustment of the latent image for an improvement in the latent image, and thus it is possible to expect an improvement in the entirety of image quality without limitation to granularity.

Specifically, there is an effect of making a latent image electric field stand, of raising the latent image resolution, and of maintaining a black pixel concentration, and thus the method is very suitable as a method of raising the resolution of only a necessary portion only at a necessary time.

For example, when performing exposure with an integrated light amount two times the reference integrated light amount, in the case of an exposure method in the related art, only an optical output is increased two times or only an exposure time is lengthened two times. Here, in the case of desiring to further improve the latent image resolution, for example, the exposure time may be shortened by half, and the optical output may be increased four times by using the TC exposure method.

Figure 27A:
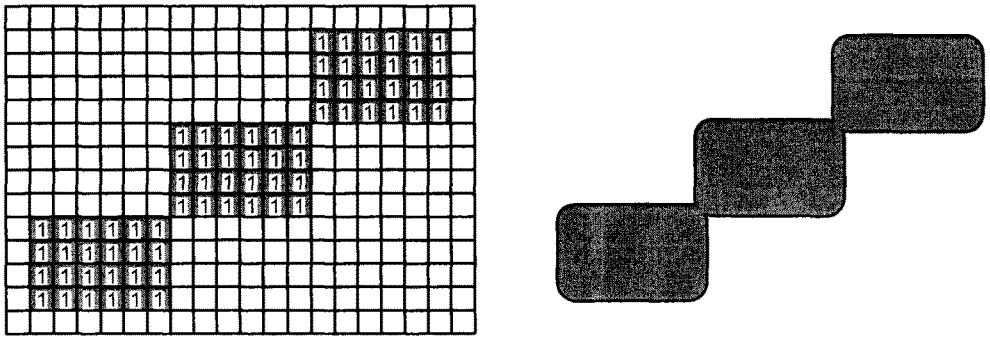
FIGS. 27A, 27B, and 27C are views illustrating an exposure amount set value with respect to each exposure pixel and an electrostatic latent image corresponding to the exposure amount set value in Comparative Example 5, Example 7, and Example 8.
Figure 27B:
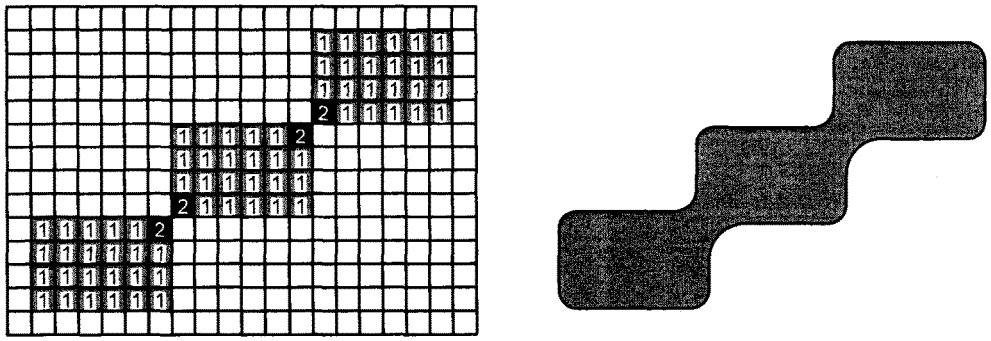
Figure 27C:
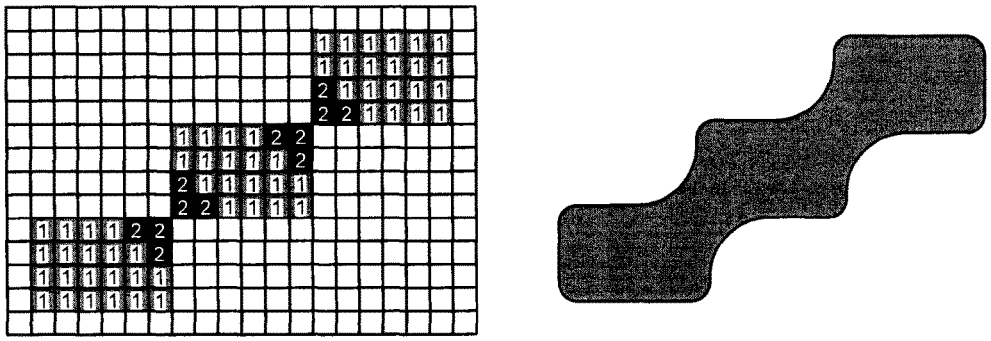

Here, in Comparative Example 5, Example 7, and Example 8 which are illustrated in FIG. 27A, FIG. 27B, and FIG. 27C, respectively, an electrostatic latent image is formed on the basis of image data in which a plurality of isolated patterns (for example, three isolated patterns) each constituted by a plurality of exposure pixels are lined up in an inclined direction in a state of being adjacent to each other at the apex of one exposure pixel. In addition, the inclined direction represents a direction that is inclined to both a row direction and a column direction of the plurality of pixels which are arranged in a matrix shape. Here, as an example, each of the isolated patterns is set as a rectangular pattern constituted by 24 exposure pixels.

In Comparative Example 5, an exposure amount of each exposure pixel in image data is set to be the same in each case (for example, a numeral "1" in a left view of FIG. 27A). In this case, there is a concern that portions of an electrostatic latent image which correspond to adjacent portions of the two adjacent isolated patterns may be blurred or disconnected (refer to a right view in FIG. 27A).

Therefore, in Example 7, an exposure amount of each one of exposure pixels which are adjacent to each other only at the apex of the respective isolated patterns is set to be greater (for example, two times) than an exposure amount (for example, a numeral "1" in a left view of FIG. 27B) of other exposure pixels (for example, a numeral "2" in the left view of FIG. 27B). In this case, it is possible to prevent the portions of the electrostatic latent image, which correspond to the adjacent portions of the two adjacent isolated patterns, from being blurred or disconnected (refer to a right view of FIG. 27B). In addition, here, the one exposure pixel is detected in advance as an exposure pixel in the specific region by the exposure amount setting unit 1060*b*.

In addition, in Example 8, an exposure amount of each of first exposure pixels adjacent to each other only at the apex of the respective isolated patterns, a second exposure pixel that is adjacent to the first exposure pixel in a row direction, and a third exposure pixel that is adjacent to the first exposure pixel in a column direction is set to be greater than an exposure amount (for example, a numeral "1" in a left view of FIG. 27C) of other exposure pixels (for example, a numeral "2" in the left view of FIG. 27C). In this case, it is possible to reliably prevent the portions of the electrostatic latent image, which correspond to the adjacent portions of the two adjacent isolated patterns, from being blurred or disconnected (refer to a right view of FIG. 27C). In addition, here, the first to third exposure pixels are detected in advance as an exposure pixel in the specific region by the exposure amount setting unit 1060*b*.

In addition, in Examples 7 and 8, each of the isolated patterns is set as a rectangular pattern constituted by 24 exposure pixels, but there is no limitation thereto.

In addition, in Example 8, an exposure amount of each exposure pixel in an L-shaped region, which has a one-pixel width and is constituted by the first to third exposure pixels in each of the isolated patterns, is set to be greater than an exposure amount of other exposure pixels. However, an exposure amount of each exposure pixel in an L-shaped region, which has a two-pixel width or greater and which includes the first to third exposure pixels, may be set to be greater than an exposure amount of other exposure pixels.

Figure 28A:
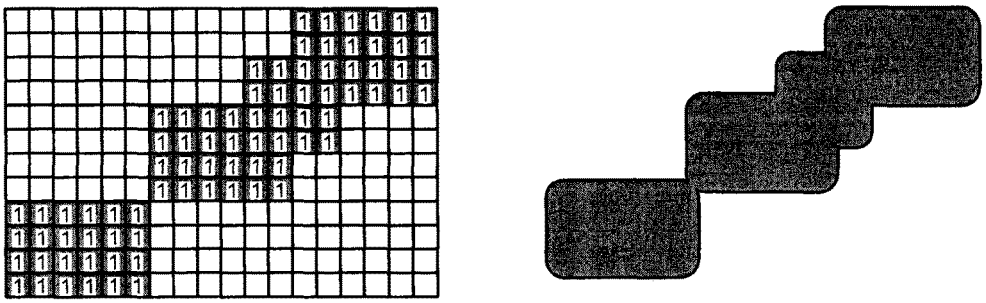
FIGS. 28A and 28B are views illustrating an exposure amount set value with respect to each exposure pixel, and an electrostatic latent image corresponding to the exposure amount set value in Comparative Example 6 and Example 9.
Figure 28B:
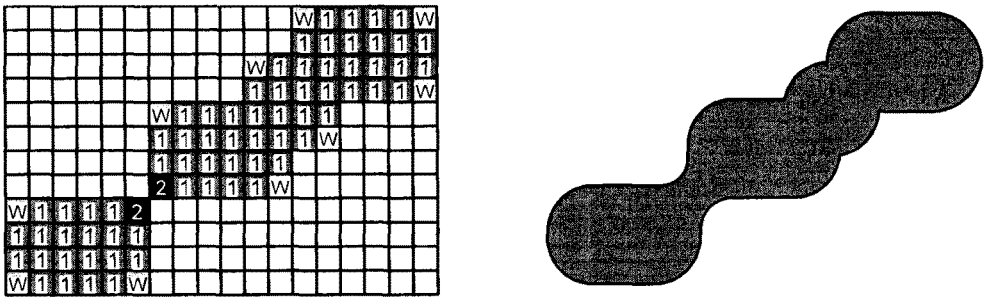

Here, in Comparative Example 6 and Example 9 illustrated in FIG. 28A and FIG. 28B, respectively, an electrostatic latent image is formed on the basis of image data in which a plurality of isolated patterns (for example, two isolated patterns) each constituted by a plurality of exposure pixels are lined up in an inclined direction in a state of being adjacent to each other at the apex of one exposure pixel. Here, as an example, one of the two isolated patterns is set as a rectangular pattern constituted by 24 exposure pixels, and the other is set as a zigzag pattern constituted by 56 exposure pixels.

In Comparative Example 6, an exposure amount of each exposure pixel in image data is set to be the same in each case (for example, a numeral "1" in a left view of FIG. 28A). In this case, there is a concern that portions of an electrostatic latent image which correspond to adjacent portions of the two adjacent isolated patterns may be blurred or disconnected, and there is a concern that jaggies may occur at a portion of the electrostatic latent image which corresponds to a corner portion of each of the isolated patterns (refer to a right view in FIG. 28A).

Therefore, in Example 9, an exposure amount of each one of first exposure pixels which are adjacent to each other only at the apex of the respective isolated patterns is set to be greater than an exposure amount (for example, a numeral "1" and a character "W" in a left view of FIG. 28B) of other exposure pixels (for example, a numeral "2" in a left view of FIG. 28B), and an exposure amount of a second exposure pixel at a corner portion (excluding adjacent portions of two adjacent isolated patterns) of each of the isolated patterns is set to be less than an exposure amount (for example, numerals "1" and "2" in the left view of FIG. 28B) of other exposure pixels (for example, a character "W" in the left view of FIG. 28B). In this case, it is possible to prevent the portions of the electrostatic latent image, which correspond to the adjacent portions of the two adjacent isolated patterns, from being blurred or disconnected, and it is possible to prevent the jaggies from occurring at a portion of the electrostatic latent image which corresponds to a corner portion of each of the isolated patterns (refer to a right view in FIG. 28B). In addition, here, the first and second exposure pixels are detected in advance as an exposure pixel in the specific region by the exposure amount setting unit 1060*b*.

In addition, in Example 9, the exposure amount of the first exposure pixel of each of the isolated pattern is set to be greater than the exposure amount of other exposure pixels. However, an exposure amount of each exposure pixel in an L-shaped region that is constituted by at least three exposure pixels including the first exposure pixel may be set to be greater than the exposure amount of other exposure pixels.

In addition, in Example 9, the exposure amount of the second exposure pixel at a corner portion (excluding adjacent portions of the two adjacent isolated patterns) of each of the isolated patterns is set to be less than the exposure amount of other exposure pixels. However, an exposure amount of each exposure pixel in an L-shaped region, which has a one-pixel width or greater and is constituted by at least three exposure pixels including the second exposure pixel, may be set to be less than the exposure amount of other exposure pixels.

Figure 29A:
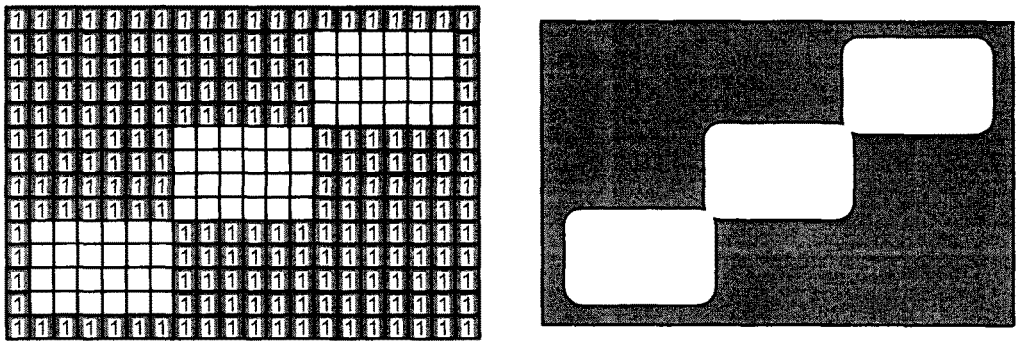
FIGS. 29A, 29B, and 29C are views illustrating an exposure amount set value with respect to each exposure pixel, and an electrostatic latent image corresponding to the exposure amount set value in Comparative Example 7, Example 10, and Example 11.
Figure 29B:
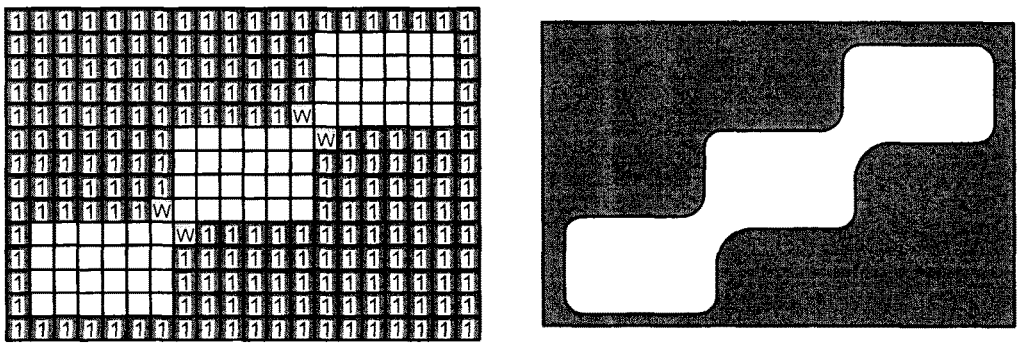
Figure 29C:
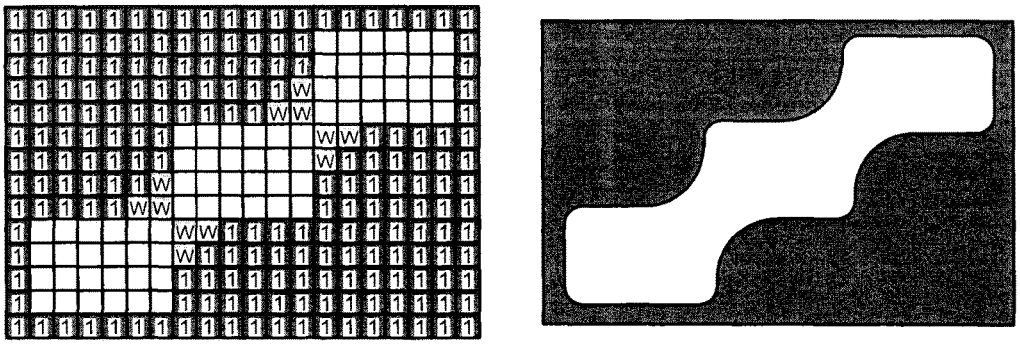

Here, in Comparative Example 7, Example 10, and Example 11 which are illustrated in FIG. 29A, FIG. 29B, and FIG. 29C, respectively, an electrostatic latent image is formed on the basis of image data in which a plurality of isolated patterns (for example, three isolated patterns) each constituted by a plurality of non-exposure pixels are lined up in an inclined direction in a state of being adjacent to each other at the apex of one non-exposure pixel. Here, each of the isolated patterns is set as a rectangular pattern constituted by 24 non-exposure pixels.

In Comparative Example 7, an exposure amount of each exposure pixel in image data is set to be the same in each case (for example, a numeral "1" in a left view of FIG. 29A). In this case, there is a concern that portions of an electrostatic latent image which correspond to adjacent portions of the two adjacent isolated patterns may be blurred or disconnected (refer to a right view in FIG. 29A).

Therefore, in Example 10, an exposure amount of a first exposure pixel that is adjacent to each one of non-exposure pixels, which are adjacent to each other only at the apex of the respective isolated patterns, in a row direction, and a second exposure pixel that is adjacent to the one non-exposure pixel in a column direction is set to be less than an exposure amount (for example, a numeral "1" in a left view of FIG. 29B) of other exposure pixels (for example, a character "W" in the left view of FIG. 29B). In this case, it is possible to prevent portions of the electrostatic latent image, which correspond to adjacent portions of the two adjacent isolated patterns, from being blurred or disconnected (refer to a right view of FIG. 29B). In addition, here, the first and second exposure pixels are detected in advance as an exposure pixel in the specific region by the exposure amount setting unit 1060*b*.

In addition, in Example 11, an amount of the first exposure pixel that is adjacent to each one of non-exposure pixels, which are adjacent to each other only at the apex of the respective isolated patterns, in a row direction, the second exposure pixel that is adjacent to the one non-exposure pixel in a column direction, a third exposure pixel that is adjacent to the first exposure pixel in a row direction, a fourth exposure pixel that is adjacent to the first exposure pixel in a column direction, a fifth exposure pixel that is adjacent to the second exposure pixel in a row direction, and a sixth exposure pixel that is adjacent to the second exposure pixel in a column direction is set to be less than an exposure amount (for example, a numeral "1" in a left view of FIG. 29C) of other exposure pixels (for example, a character "W" in the left view of FIG. 29C). In this case, it is possible to reliably prevent the portions of the electrostatic latent image, which correspond to the adjacent portions of the two adjacent isolated patterns, from being blurred or disconnected (refer to a right view of FIG. 29B). In addition, here, the first to sixth exposure pixels are detected as an exposure pixel in the specific region by the exposure amount setting unit 1060*b*.

In addition, in Examples 10 and 11, each of the isolated patterns is set as a rectangular pattern constituted by 24 non-exposure pixels, but there is no limitation thereto.

In addition, in Example 11, the exposure amount of each exposure pixel in an L-shaped region which has a one-pixel width and is constituted by the first to third exposure pixels in a peripheral region, and each exposure pixel in an L-shaped region which has a one-pixel width and is constituted by the fourth to sixth exposure pixels in the peripheral region is set to be less than the exposure amount of other exposure pixels. However, an exposure amount of each exposure pixel in an L-shaped region which has a two-pixel width or greater and includes the first and third exposure pixels in the peripheral region, and an L-shaped region which has a two-pixel width or greater and includes the fourth to sixth exposure pixels may be set to be less than the exposure amount of other exposure pixels.

Figure 30A:
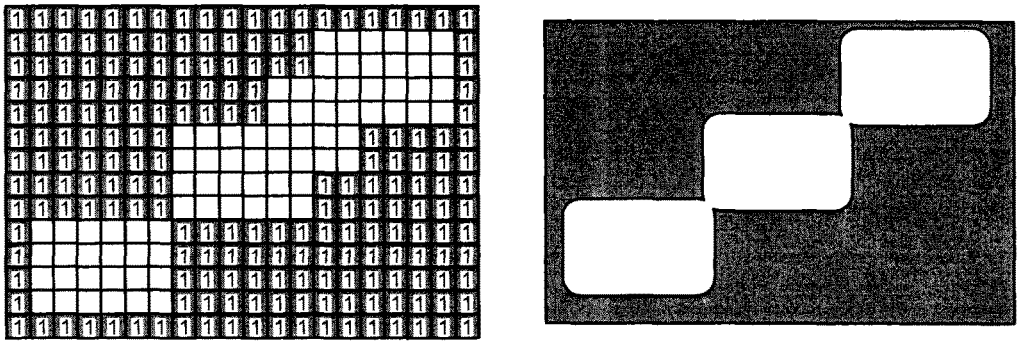
FIGS. 30A and 30B are views illustrating an exposure amount set value with respect to each exposure pixel, and an electrostatic latent image corresponding to the exposure amount set value in Comparative Example 8 and Example 12.
Figure 30B:
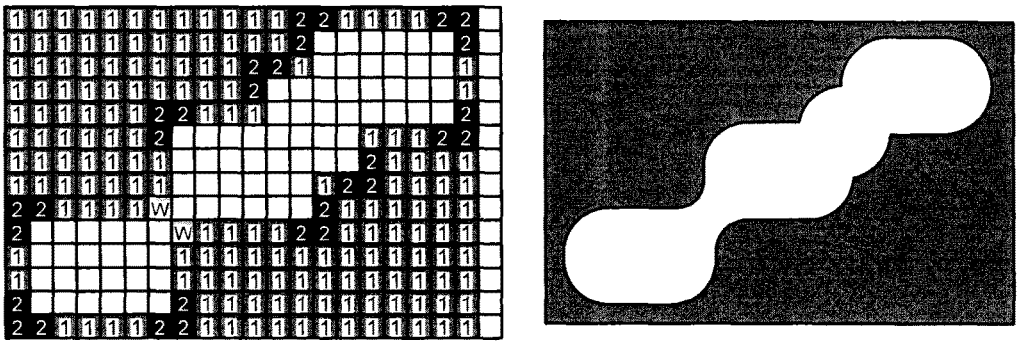
Figure 31:
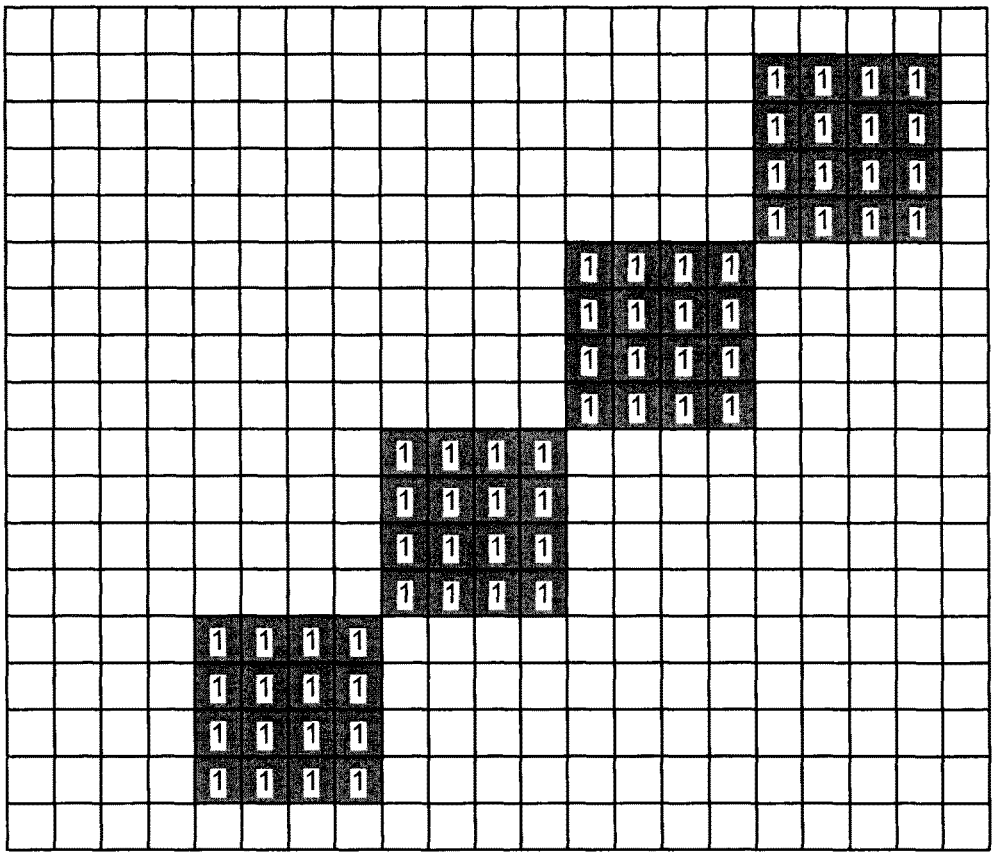
FIG. 31 is a view illustrating a plurality of isolated patterns for formation of a 45° inclined line.

Here, in Comparative Example 8 and Example 12 which are illustrated in FIG. 30A and FIG. 30B, respectively, an electrostatic latent image is formed on the basis of image data in which a plurality of isolated patterns (for example, two isolated patterns) each constituted by a plurality of non-exposure pixels are lined up in an inclined direction in a state of being adjacent to each other at the apex of one non-exposure pixel. Here, as an example, one of the two isolated patterns is set as a rectangular pattern constituted by 24 non-exposure pixels, and the other is set as a zigzag pattern constituted by 56 non-exposure pixels.

In Comparative Example 8, an exposure amount of each exposure pixel in image data is set to be the same in each case (for example, a numeral "1" in a left view of FIG. 30A). In this case, there is a concern that portions of the electrostatic latent image which correspond to adjacent portions of the two adjacent isolated patterns may be blurred or disconnected, and there is a concern that jaggies may occur at a portion of the electrostatic latent image which corresponds to a corner portion of each of the isolated patterns (refer to a right view in FIG. 30A).

Therefore, in Example 12, an exposure amount of a first exposure pixel that is adjacent to each one of first non-exposure pixels, which are adjacent to each other only at the apex of the respective isolated patterns, in a row direction, and the second exposure pixel that is adjacent to the first non-exposure pixel in a column direction is set to be less than an exposure amount (for example, numerals "1" and "2" in a left view of FIG. 30B) of other exposure pixels (for example, a character "W" in the left view of FIG. 30B), and an exposure amount of a third exposure pixel that is adjacent to a second non-exposure pixel of each corner portion (excluding adjacent portions of two adjacent isolated patterns) of the respective isolated patterns at the apex thereof, a fourth exposure pixel that is adjacent to the second non-exposure pixel in a row direction, and a fifth exposure pixel that is adjacent to the second non-exposure pixel in a column direction is set to be greater than an exposure amount (for example, a numeral "1" and a character "W" in a left view of FIG. 30B) of other exposure pixels (for example, a numeral "2" in the left view of FIG. 30B). In this case, it is possible to prevent portions of the electrostatic latent image, which correspond to adjacent portions of two adjacent isolated patterns, from being blurred or disconnected, and it is possible to prevent the jaggies from occurring at a portion of the electrostatic latent image which corresponds to a corner portion of each of the isolated patterns (refer to a right view in FIG. 30B). In addition, here, the first to fifth exposure pixels are detected in advance as an exposure pixel in the specific region by the exposure amount setting unit 1060*b*.

In addition, in Example 12, the exposure amount of the first and second exposure pixels in a peripheral region is set to be less than the exposure amount of other exposure pixels. However, an exposure amount of each exposure pixel in an L-shaped region, which includes at least three exposure pixels constituted by the first exposure pixel in the peripheral region and has a one-pixel width or greater, may be set to be less than the exposure amount of other exposure pixels.

In addition, in Example 12, an exposure amount of each exposure pixel in an L-shaped region, which is constituted by the third to fifth exposure pixels in the peripheral region and has a one-pixel width, is set to be greater than the exposure amount of other exposure pixels. However, an exposure amount of each exposure pixel in an L-shaped region, which includes the third to fifth exposure pixels in the peripheral region and has a two-pixel width or greater, may be set to be greater than the exposure amount of other exposure pixels.

According to Examples 7 to 12 as described above, in a case where a plurality of isolated patterns included in image data are arranged to be adjacent to each other so as to form an oblique line or a curved line, it is possible to improve reproducibility of the oblique line or the curved line.

In addition, in Examples 7 to 12, the number of isolated patterns which are lined up to be adjacent to each other in an inclined direction is set to three or two, but the number of the isolated patterns may be appropriately changed without limitation thereto.

In addition, it can be seen that setting of the exposure amount as illustrated in Examples 7 to 12 is particularly effective, for example, in the case of forming a line width of 0.06 pt, and an inclined line of 45° (solid black or void). The inclined line is formed on the basis of a pattern obtained by connecting a plurality of (for example, four) isolated patterns of 4×4 dots with resolution of 4800 dpi.

The laser printer 1000 of this embodiment (Examples 1, 3, 4, 7, 8, and 9) described above is an image forming apparatus that forms an image by exposing the photoconductor drum 1030 on the basis of image data including at least one isolate pattern (a predetermined pattern). The isolated pattern is constituted by a plurality of exposure pixels, and a peripheral region of the isolated pattern in the image data is constituted by a plurality of non-exposure pixels. The laser printer 1000 includes a printer control device 1060 (processing device) which detects a specific region which is adjacent to a boundary between the isolated pattern and the peripheral region and is constituted by at least one exposure pixel in the isolated pattern, and which sets an exposure amount with respect to an exposure pixel in the specific region and an exposure amount with respect to an exposure pixel in a region other than the specific region in the isolated pattern to values different from each other.

In addition, the laser printer 1000 of this embodiment (Examples 2, 5, 6, and 10 to 12) is an image forming apparatus that forms an image by exposing the photoconductor drum 1030 on the basis of image data including at least one isolated pattern (predetermined pattern). A peripheral region of the isolated pattern in the image data constituted by a plurality of exposure pixels, and the isolated pattern is constituted by a plurality of non-exposure pixels. The laser printer 1000 includes a printer control device 1060 (processing device) which detects a specific region which is adjacent to a boundary between the isolated pattern and the peripheral region and is constituted by at least one exposure pixel in the peripheral region, and sets an exposure amount with respect to an exposure pixel in the specific region and an exposure amount with respect to an exposure pixel in a region other than the specific region in the peripheral region to values different from each other.

In the laser printer 1000 of this embodiment (Examples 1 to 12), it is possible to form an image approximated to a target image on the photoconductor drum 1030.

As a result, it is possible to improve the reproducibility of an image.

It is preferable that the laser printer 1000 have at least one of a function of performing several processes of Examples 1, 3, 4, 7, 8, and 9 in a case where the isolated pattern is constituted by a plurality of exposure pixels, and a function of performing several processes of Examples 2, 5, 6, and 10 to 12 in a case where the isolated pattern is constituted by a plurality of non-exposure pixels.

In addition, in the above-described embodiment, as an exposure device of exposing the photoconductor drum, the optical scanning device is used, but there is no limitation thereto. For example, an optical print head, which includes at least a plurality of light-emitting portions arranged to be spaced away from each other in a direction parallel with a longitudinal direction of the photoconductor drum, may be used. That is, the photoconductor drum may be exposed by rotating the photoconductor drum 1030 with respect to light emitted from the optical print head.

In addition, in the above-described embodiment, as a light source, the LD array including a plurality of LDs or the VCSEL array including a plurality of VCSELs is used, but a single LD or VCSEL, a laser other than a semiconductor laser, an LED array including a single LED (light-emitting diode) or a plurality of LEDs, and an organic EL element array including a single organic EL element or a plurality of organic EL elements may be used.

In addition, in the above-described embodiment, as the image forming apparatus of the invention, the laser printer 1000 is employed, but there is no limitation thereto. For example, the image forming apparatus of the invention may be a color printer including a plurality of photoconductor drums.

In addition, the image forming apparatus of the invention may be an image forming apparatus using a silver salt film as an image bearer. In this case, a latent image is formed on the silver salt film due to optical scanning, and the latent image may be visualized through the same process as a development process in a typical silver salt photography process. Then, the latent image can be transferred to printing paper through the same process as a baking process in the typical silver salt photography process. The image forming apparatus can be executed as an optical plate-making apparatus or an optical drawing apparatus that draws a CT scanning image and the like.

In addition, the invention is also applicable to an image forming apparatus such as a digital copying machine in addition to the laser printer and the color printer as described above. In brief, the invention is applicable to whole image forming apparatuses which form an image by exposing an image carrier on the basis of image data.

According to the present embodiments, it is possible to improve the reproducibility of an image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image by exposing an image bearer based on image data including a predetermined pattern, comprising:

circuitry configured to:

set an exposure amount of a plurality of exposure pixels, the predetermined pattern being constituted by the plurality of exposure pixels, and a peripheral region in the image data being constituted by a plurality of non-exposure pixels;

set a first exposure amount of a first exposure pixel in a specific region that is adjacent to a boundary between the predetermined pattern and the peripheral region and is constituted by at least one exposure pixel of the predetermined pattern, and a second exposure amount of a second exposure pixel in a region other than the specific region in the predetermined pattern to values different from each other; and set the first exposure amount of the first exposure pixel in the specific region to be greater than the second exposure amount of the second exposure pixel in the region other than the specific region, wherein another predetermined pattern is arranged in a direction adjacent to the predetermined pattern at an apex of one exposure pixel of each of the predetermined pattern and the another predetermined pattern, and another region, which is constituted by the one exposure pixel of each of the predetermined pattern and the another predetermined pattern, is included in the specific region in the predetermined pattern.

2. The image forming apparatus according to claim 1, wherein the specific region is a region that surrounds an entire perimeter of the region other than the specific region.

3. The image forming apparatus according to claim 1, wherein when a total area of the predetermined pattern is equal to or less than a first reference area, the circuitry is configured to change a total exposure amount of the specific region to monotonically increase with respect to an increase in the total area.

4. The image forming apparatus according to claim 3, wherein when the total area is equal to or less than a second reference area that is less than the first reference area, the circuitry is configured to set the total exposure amount of the specific region to be two or more times a total exposure amount of the region other than the specific region.

5. The image forming apparatus according to claim 1, wherein a corner portion, which is constituted by at least one exposure pixel of each of the predetermined pattern and the another predetermined pattern, is included in the specific region in the predetermined pattern, and the circuitry is configured to set an exposure amount of an exposure pixel at the corner portion to be less than an exposure amount of an exposure pixel in the region other than the specific region.

6. The image forming apparatus according to claim 1, wherein a width of the specific region equals a width of at least one pixel.

7. The image forming apparatus according to claim 1, wherein a shape of the predetermined pattern is a square.

8. The image forming apparatus according to claim 1, wherein the circuitry is configured to set, for the first exposure pixel in the specific region, a light amount exposing the image bearer to be greater and an exposure time exposing the image bearer to be shorter, compared to a case of exposing the second exposure pixel in the region other than the specific region.

9. The image forming apparatus according to claim 1, wherein, when a total area of the predetermined pattern is equal to or less than a first reference area and greater than a second reference area, the circuitry is configured to change a total exposure amount of the specific region at a first rate with respect to an increase in the total area of the predetermined pattern, wherein, when the total area of the predetermined pattern is equal to or less than the second reference area, the circuitry is configured to change the total exposure amount of the specific region at a second rate with respect to the increase in the total area of the predetermined pattern, wherein the first rate is smaller than the second rate.

10. An image forming apparatus that forms an image by exposing an image bearer based on image data including a predetermined pattern, comprising:

circuitry configured to:

set an exposure amount of a plurality of exposure pixels, a peripheral region in the image data being constituted by the plurality of exposure pixels, and the predetermined pattern being constituted by a plurality of non-exposure pixels;

set a first exposure amount of a first exposure pixel in a specific region that is adjacent to a boundary between the predetermined pattern and the peripheral region and is constituted by at least one exposure pixel of the peripheral region, and a second exposure amount of a second exposure pixel in a region other than the specific region in the peripheral region to values different from each other; and set the first exposure amount of the first exposure pixel in the specific region to be less than the second exposure amount of the second exposure pixel in the region other than the specific region, wherein another predetermined pattern is arranged in a direction adjacent to the predetermined pattern at an apex of one non-exposure pixel of each of the predetermined pattern and the another predetermined pattern, and another region, which is adjacent to the one non-exposure pixel of each of the predetermined pattern and the another predetermined pattern and which is constituted by the at least one exposure pixel of the peripheral region, is included in the specific region in the peripheral region.

11. The image forming apparatus according to claim 10, wherein the specific region is a region that surrounds an entire perimeter of the predetermined pattern.

12. The image forming apparatus according to claim 10, wherein when a total area of the predetermined pattern is equal to or less than a first reference area, the circuitry is configured to change a total exposure amount of the specific region to monotonically increase with respect to an increase in the total area.

13. The image forming apparatus according to claim 12, wherein when the total area is equal to or less than a second reference area that is less than the first reference area, the circuitry is configured to set the total exposure amount of the specific region to be 0.8 or less times a total exposure amount of the region other than the specific region.

14. The image forming apparatus according to claim 10, wherein an adjacent region, which is adjacent to a non-exposure pixel of a corner portion constituted by at least one non-exposure pixel of each of the predetermined pattern and the another predetermined pattern and is constituted by the at least one exposure pixel of the peripheral region, is included in the specific region, and the circuitry is configured to set an exposure amount of an exposure pixel in the adjacent region to be greater than an exposure amount of an exposure pixel in the region other than the specific region.

15. The image forming apparatus according to claim 10, wherein a width of the specific region equals a width of at least one pixel.

16. The image forming apparatus according to claim 10, wherein a shape of the predetermined pattern is a square.

17. The image forming apparatus according to claim 10, wherein, when a total area of the predetermined pattern is equal to or less than a first reference area and greater than a second reference area, the circuitry is configured to change a total exposure amount of the specific region at a first rate with respect to an increase in the total area of the predetermined pattern, wherein, when the total area of the predetermined pattern is equal to or less than the second reference area, the circuitry is configured to change the total exposure amount of the specific region at a second rate with respect to the increase in the total area of the predetermined pattern, wherein the second rate is smaller than the first rate.

18. An image forming method that forms an image by exposing an image bearer based on image data including a predetermined pattern, comprising:

detecting a specific region, which is adjacent to a boundary of the predetermined pattern and a peripheral region in the image data, and includes at least one exposure pixel in the predetermined pattern, the predetermined pattern being constituted by a plurality of exposure pixels, and the peripheral region being constituted by a plurality of non-exposure pixels;

setting a first exposure amount of a first exposure pixel in the specific region and a second exposure amount of a second exposure pixel in a region other than the specific region in the predetermined pattern to values different from each other; and setting the first exposure amount of the first exposure pixel in the specific region to be greater than the second exposure amount of the second exposure pixel in the region other than the specific region, wherein another predetermined pattern is arranged in a direction adjacent to the predetermined pattern at an apex of one exposure pixel of each of the predetermined pattern and the another predetermined pattern, and another region, which is constituted by the one exposure pixel of each of the predetermined pattern and the another predetermined pattern, is included in the specific region in the predetermined pattern.

* * * * *